US007997679B2

(12) United States Patent
Yakura et al.

(10) Patent No.: US 7,997,679 B2
(45) Date of Patent: Aug. 16, 2011

(54) IMAGE FORMING APPARATUS AND CONTROLLING METHOD THEREFOR

(75) Inventors: Yuji Yakura, Kanagawa (JP); Kenji Suzuki, Kanagawa (JP); Hiroshi Tokunaga, Tokyo (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 444 days.

(21) Appl. No.: 12/077,289

(22) Filed: Mar. 18, 2008

(65) Prior Publication Data

US 2008/0180472 A1 Jul. 31, 2008

Related U.S. Application Data

(62) Division of application No. 10/488,831, filed as application No. PCT/JP03/008663 on Jul. 8, 2003, now abandoned.

(30) Foreign Application Priority Data

Jul. 9, 2002 (JP) ..... P2002-200427
Jul. 9, 2002 (JP) ..... P2002-200428

(51) Int. Cl.
*B41J 29/393* (2006.01)
*B41J 2/165* (2006.01)

(52) U.S. Cl. ..... 347/19; 347/23

(58) Field of Classification Search ..... 347/19, 347/23, 25, 35

See application file for complete search history.

(56) References Cited

U.S. PATENT DOCUMENTS 5,617,122 A 4/1997 Numata et al.
6,042,218 A 3/2000 Nakahara
6,142,600 A 11/2000 Takahashi et al.
6,808,247 B2 * 10/2004 Kawatoko et al. ..... 347/23

FOREIGN PATENT DOCUMENTS

| | | |
|---|---|---|
| EP | 1 205 307 | 5/2002 |
| JP | 03-005186 | 1/1991 |
| JP | 07-047696 | 2/1995 |
| JP | 10-264407 | 10/1998 |
| JP | 11-342621 | 12/1999 |
| JP | 2001-010083 | 1/2001 |

* cited by examiner

*Primary Examiner* — Geoffrey Mruk

(74) *Attorney, Agent, or Firm* — Robert J. Depke; Rockey, Depke & Lyons, LLC

(57) ABSTRACT

An image forming apparatus for forming an image on a recording medium is disclosed. The image forming apparatus includes a print head (4) having an ink emitting surface (6) in which there are formed a plural number of ink emitting openings (13). An ink is emitted from the ink emitting openings (13) for forming an image on a recording medium. The image forming apparatus also includes an emission controller (41) for controlling the ink emission from the ink emitting openings (13) formed in the ink emitting surface (6). The emission controller (41) is responsive to an input image signal to control the quantity of preliminary ink emission from one or more of the ink emitting openings (13) or to select one or more of the ink emitting openings (13). In this manner, the quantity of the preliminary ink emission from the ink emitting openings (13) is controlled, or one or more of the ink emitting openings (13) is selected, responsive to the image signal, to diminish the wasteful ink emission and to clean the ink emitting openings (13) or the vicinity without damaging the ink emitting surface (6).

10 Claims, 16 Drawing Sheets

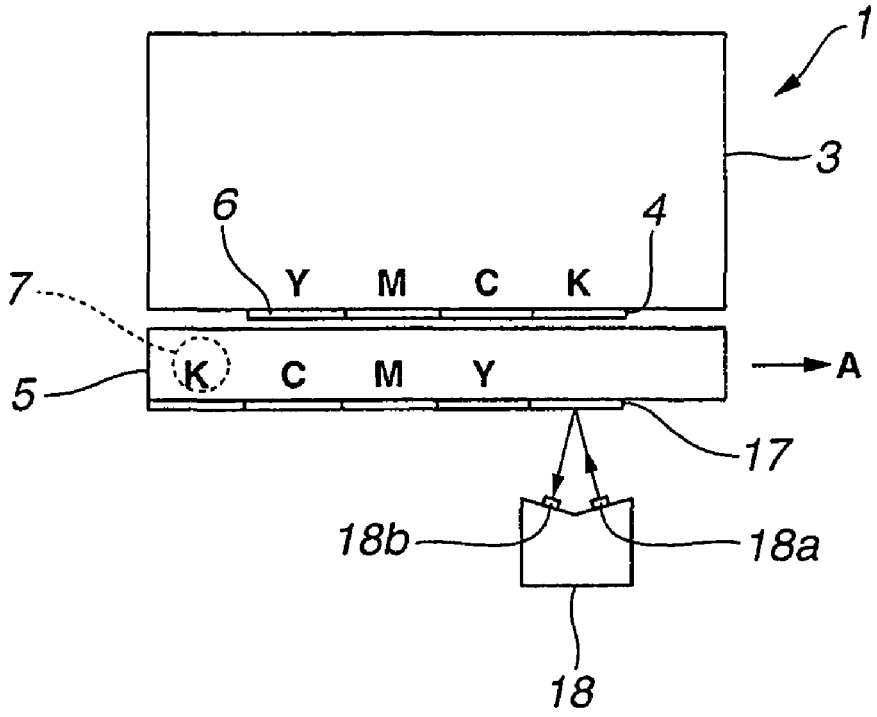
FIG.7
FIG.8A
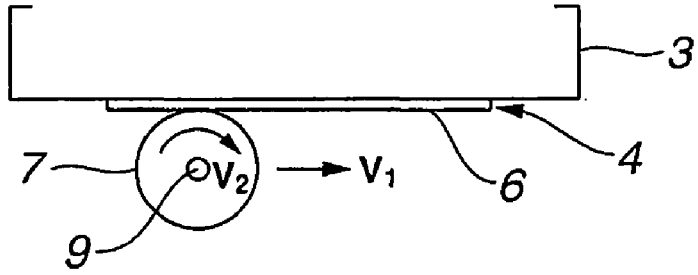
FIG.8B
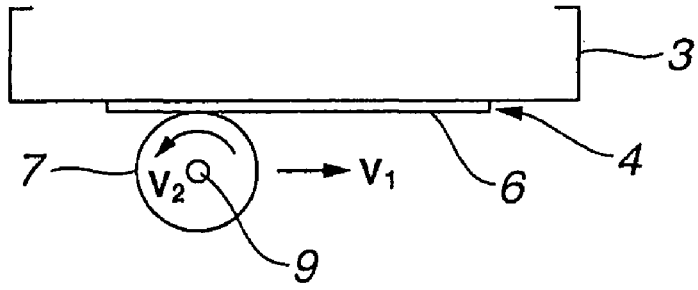

IMAGE FORMING APPARATUS AND CONTROLLING METHOD THEREFOR

The subject matter of application Ser. No. 10/488,831 is incorporated herein by reference. The present application is a divisional of U.S. application Ser. No. 10/488,831, filed Nov. 15, 2004, now abandoned which is a 371 U.S. National Stage filing of PCT/JP2003/008663, filed Jul. 8, 2003, which claims priority of Japanese Patent Application No. 2002-200427, and Japanese Patent Application No. 2002-200428, both filed in Japan on Jul. 9, 2002, the entireties of which are incorporated by reference herein.

TECHNICAL FIELD

This invention relates to an image forming apparatus for emitting the ink from an ink emission opening to form an image on a recording medium, and a controlling method therefor.

BACKGROUND ART

An ink jet image forming apparatus, for example an ink jet printer, is in widespread use, because of low running costs and ease in forming a colored print image and in reducing the size of the apparatus. This ink jet printer is configured for emitting a minor quantity of the ink from small-sized ink emitting openings formed in an ink emitting surface of a print head to record an image. If the printing operation has not been performed for an extended period of time, such that the ink has not been emitted from the ink emitting openings in the print head for prolonged time, the ink deposited to near the ink emitting openings formed in the ink emitting surface by the last printing operation tends to be vaporized or dried, that is, thickened or solidified, with the result that it is difficult to effect normal ink emission.

In such ink jet printer, it has been known that, if the ink is emitted from a given ink jet opening in order to effect printing on a recording medium, and subsequently the ink is not emitted on end for several to tens of seconds, the ink deposited to or near the ink emitting opening formed in the ink emitting surface tends to be vaporized or dried, that is, thickened or solidified. For this reason, the ink is preliminarily emitted even during the time interval the printing operation is not performed, in order that the ink deposited to or near the ink emitting opening formed in the ink emitting surface by the previous printing operation is not vaporized and dried, that is, thickened and solidified.

On the other hand, in the preliminary ink emission from the ink emission opening, the preliminary emission is carried out in a constant quantity, without dependency on the size of the recording medium.

With the conventional technique, described above, the quantity or the color of the ink preliminarily emitted from the ink emitting opening is not controlled in the operation of the preliminary ink emission in the ink jet printer, in dependence upon the quantity of the ink emitted last time from the ink emitting opening, image data or the color of the emitted ink, with the consequence that the quantity of the ink used in the preliminary ink emission is increased.

With the conventional technique, described above, control of the quantity of the preliminary ink emission from given ink emitting openings or selection of the ink emitting openings in the operation of the preliminary emission of the ink jet printer is not made in dependency upon the ink emitting position during the printing operation prior to the operation of the preliminary emission via the ink emitting openings, with the consequence that the quantity of the ink used in the preliminary ink emission is increased. Moreover, in the conventional operation of the preliminary ink emission, the operation of the preliminary ink emission is made at a constant quantity at every ink emitting opening regardless of the size of the recording medium, so that the ink is preliminarily emitted from ink emitting openings for a non-printed space on the recording medium, if there is such space, thus leading to wasteful consumption of the preliminarily emitted ink.

In order to prevent the large consumption of ink due to the preliminary ink emission, it may be contemplated to use a blade to clean the ink emitting openings. However, a certain quantity of the ink tends to be left in the vicinity of the ink emitting openings by such wiping with the blade, with the result that sufficient cleaning cannot be achieved.

Meanwhile, if plural blades are mounted on a rotary shaft for rotation, there is still the risk of damaging the ink emitting surface. In addition, since reliance is placed only on the wiping effect, there is presented a problem that the ink is left in the vicinity of the ink emitting openings.

DISCLOSURE OF THE INVENTION

It is an object of the present invention to provide a novel image forming apparatus, capable of resolving the problem inherent in the above-described conventional ink jet printer, and a control method therefor.

It is another object of the present invention to provide an image forming apparatus, in which the quantity of wasteful ink emission can be diminished without damaging the ink emitting surface to achieve the effect of cleaning the vicinity of the ink emitting openings, and a control method therefor.

For accomplishing the above objects, the present invention provides an image forming apparatus including a print head provided with an ink emitting surface having a plurality of ink emitting openings, in which an ink is emitted from the ink emitting openings to form an image on a recording medium, and in which the apparatus comprises emission controlling means for controlling the operation of ink emission from the ink emitting openings in the ink emitting surface. The emission controlling means controls the quantity of preliminary emission of the ink via one or more of the openings in dependency upon a supplied image signal.

For accomplishing the above objects, the present invention also provides an image forming apparatus including a print head provided with an ink emitting surface having a plurality of the ink emitting openings, in which an ink is emitted from the ink emitting openings to form an image on a recording medium, and in which the apparatus comprises emission controlling means for controlling the operation of ink emission from the ink emitting openings in the ink emitting surface. The emission controlling means selects one or more of the ink emitting openings for preliminary ink emission in dependency upon a supplied image signal.

For accomplishing the above objects, the present invention also provides a method for controlling an image forming apparatus including a print head provided with an ink emitting surface having a plurality of ink emitting openings, and emission controlling means for controlling the operation of ink emission from the ink emitting openings in the ink emitting surface, in which an ink is emitted from the ink emitting openings to form an image on a recording medium. The emission controlling means controls the quantity of preliminary emission of the ink via one or more of the ink emitting openings in dependency upon a supplied image signal.

For accomplishing the above objects, the present invention also provides a method for controlling an image forming apparatus including a print head provided with an ink emitting surface having a plurality of ink emitting openings, and emission controlling means for controlling the operation of ink emission from the ink emitting openings in the ink emitting surface, in which an ink is emitted from the ink emitting openings to form an image on a recording medium. The emission controlling means performs control for selecting one or more of the ink emitting openings in dependency upon a supplied image signal.

For accomplishing the above objects, the present invention also provides an image forming apparatus including a print head provided with an ink emitting surface having a plurality of ink emitting openings, in which an ink is emitted from the ink emitting openings to form an image on a recording medium, and in which the apparatus comprises emission controlling means for controlling the operation of ink emission from the ink emitting openings in the ink emitting surface. The emission controlling means controls the quantity of preliminary emission of the ink via one or more of the ink emitting openings in dependency upon an ink emitting position corresponding to the size of the recording medium during the printing operation prior to the operation of the preliminary emission via the ink emitting openings.

For accomplishing the above objects, the present invention also provides an image forming apparatus including a print head provided with an ink emitting surface having a plurality of ink emitting openings, in which an ink is emitted from the ink emitting openings to form an image on a recording medium, and in which the apparatus comprises emission controlling means for controlling the operation of ink emission from the ink emitting openings in the ink emitting surface. The emission controlling means controls the quantity of preliminary emission of the ink via one or more of the ink emitting openings in dependency upon an ink emitting position corresponding to the size of the recording medium during the printing operation prior to the operation of the preliminary emission via the ink emitting openings and upon a supplied image signal.

For accomplishing the above objects, the present invention also provides an image forming apparatus including a print head provided with an ink emitting surface having a plurality of ink emitting openings, in which an ink is emitted from the ink emitting openings to form an image on a recording medium, and in which the apparatus comprises emission controlling means for controlling the operation of ink emission from the ink emitting openings in the ink emitting surface. The emission controlling means selects one or more of the ink emitting openings for preliminary ink emission in dependency upon an ink emitting position corresponding to the size of the recording medium during the printing operation prior to the operation of the preliminary emission via the ink emitting openings.

For accomplishing the above objects, the present invention also provides an image forming apparatus including a print head provided with an ink emitting surface having a plurality of ink emitting openings, in which an ink is emitted from the ink emitting openings to form an image on a recording medium, and in which the apparatus comprises emission controlling means for controlling the operation of ink emission from the ink emitting openings in the ink emitting surface. The emission controlling means selects one or more of the ink emitting openings for preliminary ink emission in dependency upon an ink emitting position corresponding to the size of the recording medium during the printing operation prior to the operation of the preliminary emission via the ink emitting openings and upon a supplied image signal.

For accomplishing the above objects, the present invention also provides a method for controlling an image forming apparatus including a print head provided with an ink emitting surface having a plurality of ink emitting openings, and emission controlling means for controlling the operation of ink emission from the ink emitting openings in the ink emitting surface, in which an ink is emitted from the ink emitting openings to form an image on a recording medium. The emission controlling means controls the quantity of preliminary ink emission from one or more of the ink emitting opening in dependency upon an ink emitting position corresponding to the size of the recording medium during the printing operation prior to the operation of the preliminary emission via one or more of the ink emitting openings.

For accomplishing the above objects, the present invention also provides a method for controlling an image forming apparatus including a print head provided with an ink emitting surface having a plurality of ink emitting openings, and emission controlling means for controlling the operation of ink emission from the ink emitting openings in the ink emitting surface, in which an ink is emitted from the ink emitting openings to form an image on a recording medium. The emission controlling means controls the quantity of preliminary ink emission from one or more of the ink emitting openings in dependency upon an ink emitting position corresponding to the size of the recording medium during the printing operation prior to the operation of the preliminary emission via one or more of the ink emitting openings and upon a supplied image signal.

For accomplishing the above objects, the present invention also provides a method for controlling an image forming apparatus including a print head provided with an ink emitting surface having a plurality of ink emitting openings, and emission controlling means for controlling the operation of ink emission from the ink emitting openings in the ink emitting surface, in which an ink is emitted from the ink emitting openings to form an image on a recording medium. The emission controlling means performs control for selecting one or more of the ink emitting opening in dependency upon an ink emitting position corresponding to the size of the recording medium during the printing operation prior to the operation of the preliminary emission via one or more of the ink emitting openings.

For accomplishing the above objects, the present invention also provides a method for controlling an image forming apparatus including a print head provided with an ink emitting surface having a plurality of ink emitting openings, and emission controlling means for controlling the operation of ink emission from the ink emitting openings in the ink emitting surface, in which an ink is emitted from the ink emitting openings to form an image on a recording medium. The emission controlling means performs control for selecting one or more of the ink emitting openings in dependency upon an ink emitting position corresponding to the size of the recording medium during the printing operation prior to the operation of the preliminary emission via one or more of the ink emitting openings and upon a supplied image signal.

Other objects and specified advantages that may be achieved in accordance with the present invention will become more apparent from the following description of the preferred embodiments thereof especially when read in conjunction with the accompanying drawings.

BRIEF DESCRIPTION OF THE DRAWINGS

FIG. 7 illustrates means for detecting the timing of preliminary ink emission from the ink emission opening which is carried out when the head cap is moved relative to the print head.

FIGS. 8A and 8B are schematic views for illustrating a modification of the cleaning roll.

BEST MODE FOR CARRYING OUT THE INVENTION

Preferred embodiments of the present invention are now explained with reference to the accompanying drawings.

Figure 1:
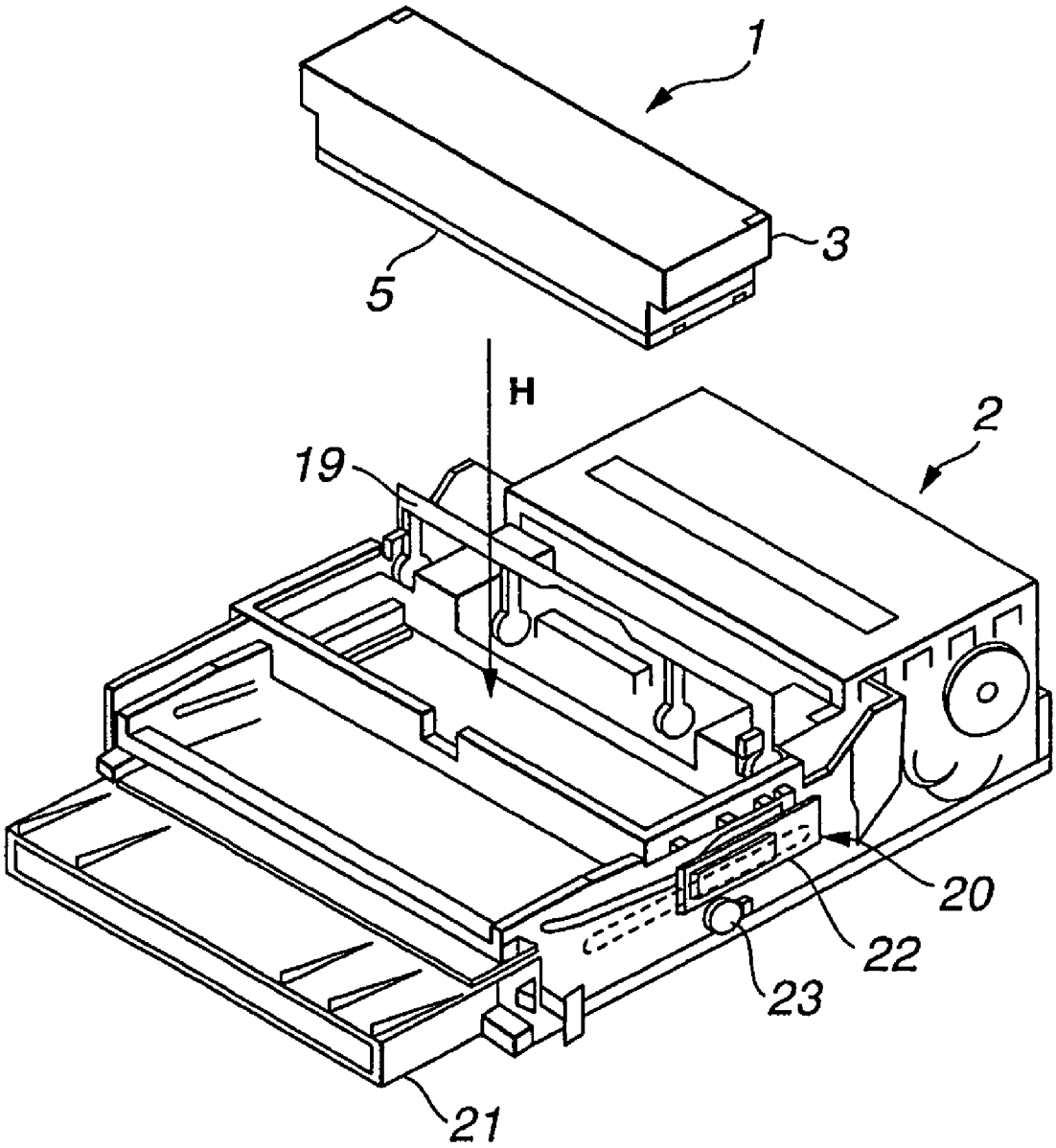
FIG. 1 is a perspective view showing an ink jet printer as an example of an image forming apparatus according to the present invention.

FIG. 1 shows, in a perspective view, an ink jet printer as an example of an image forming apparatus according to the present invention. This ink jet printer is of the type in which an ink jet head 1 is of the independent configuration and is directly loaded on a main body unit of the printer 2. The ink jet head 1 is introduced in a direction of arrow H in the drawing and set in a stationary state within the main body unit of the printer 2.

The ink jet head 1 divides the liquid ink by e.g. an electro-thermal or electro-mechanical transducer into fine droplets which are then emitted and sprayed as ink dots on a recording sheet (recording medium). The ink jet head includes an ink cartridge 3, a print head 4 and a head cap 5, as shown in FIGS. 1 and 2.

The ink cartridge 3 holds the ink of one or plural colors and has a casing elongated in shape along the width-wise direction of the main body unit of the printer 2, that is, along the width-wise direction of the recording sheet, as shown in FIG. 1. Within the casing, there is provided an ink chamber divided into four sections, charged with four colors of the inks, namely yellow Y, magenta M, cyan C and black K, in a manner not shown. The ink cartridge 3 is formed e.g. of hard resin.

Figure 2:
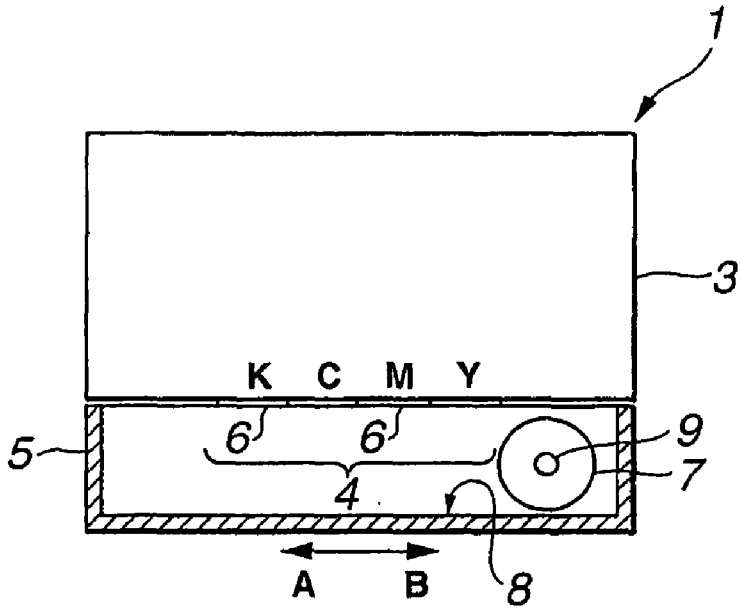
FIG. 2 is an enlarged transverse cross-sectional view of an ink jet head shown in FIG. 1.

On the bottom of the ink cartridge 3 is mounted the print head 4, as shown in FIG. 2 (enlarged transverse cross-sectional view showing the ink jet head 1 shown in FIG. 1). This print head 4 divides the ink, supplied from the ink cartridge 3, into fine droplets, to emit the so produced fine ink droplets, and includes plural ink emitting surfaces 6 each provided with fine-sized ink emitting openings along the longitudinal direction of the ink cartridge 3 across the entire width of the recording sheet. These ink emitting surfaces 6 are each formed of nickel or a nickel-containing material to a thin sheet by a nickel electro-casting method, and are extended along the longitudinal direction of the ink cartridge 3. Each ink emitting surface is provided with columns of four-colored ink emitting openings of yellow Y, magenta M, cyan C and black K, and is designed as a unitary line head for four colors.

Although not shown, the portions of the ink emitting surfaces 6 having the columns of the ink emitting openings of the respective colors of Y, M, C and K and the convexed portions on both sides of the ink emitting openings in register with the resin coating for head electrodes are formed as corrugated surfaces.

On the bottom surface of the ink cartridge 3 is mounted the head cap 5. This head cap 5 is used for holding therein a cleaning roll 7, as later explained, and operates as a cap member for covering the ink emitting surfaces 6 of the print head 4 and for protecting the ink emitting openings against drying or clogging. The head cap is in the form of a shallow box elongated to a length equal to that of the casing of the ink cartridge 3 and which is opened on its top surface. The head cap is movable relative to and dismountable from the print head 4. The head cap 5 is movable by movement means, such as a motor, along the direction of an arrow A or an arrow B, that is, in a direction perpendicular to the longitudinal direction of the ink emitting surfaces 6 of the print head 4. When moved in the direction of the arrow A, the head cap is dismounted from the ink cartridge 3 and, when returned in the direction of the arrow B, the head cap is again mounted on the ink cartridge 3. Meanwhile, the head cap 5 is formed of, e.g., a hard resin.

Within the inside of the head cap 5, there is mounted the cleaning roll 7. This cleaning roll 7, operating as a cleaning member for cleaning the ink emitting surfaces 6 of the print head 4, is formed of an elastic material to a columnar shape, and is mounted on one inner lateral side of the head cap 5 along the longitudinal direction of the head cap 5. Thus, the cleaning roll 7 is provided extending parallel to the ink emitting surfaces 6 of the print head 4. The cleaning roll 7 is moved along with the head cap 5 in the direction of the arrow A to clean the ink emitting surfaces 6 of the print head 4.

Within the inside of the head cap 5, there is also provided an ink reservoir 8. This ink reservoir 8, into which is poured preliminarily emitted ink from the ink emission opening of the print head 4, is formed by part or all of the bottom surface of the head cap 5, designed as a box of shallow depth, in which to receive the preliminarily emitted ink.

Figure 3:
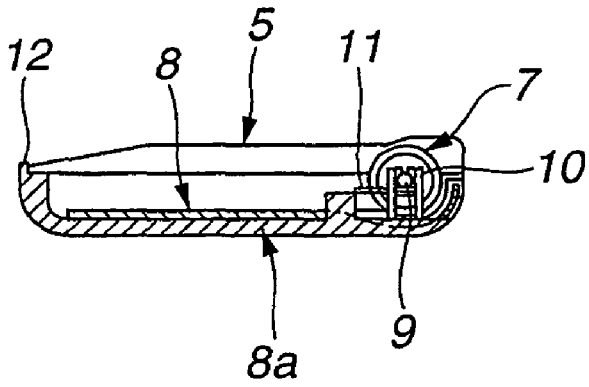
FIG. 3 is a side view showing specified examples of a head cap, a cleaning roll and an ink reservoir shown in FIG. 2.

A specified example of the head cap 5, and the cleaning roll 7 is now explained with reference to FIGS. 3 to 5. First, in FIG. 4, the head cap 5 is of an elongated shape, in meeting in width and length with the ink cartridge 3 shown in FIG. 1, and is designed in the form of a shallow bottomed box on the entire rim of which is formed a sidewall and which is opened at the top, as shown in FIG. 3. As aforesaid, the head cap 5 is moved in a direction indicated by arrow A or arrow B in FIG. 2, that is, in a direction perpendicular to the longitudinal direction of the ink emitting surfaces 6 of the print head 4. As positioning means for the head cap, about to be mounted again to the ink cartridge 3 when the head cap has been returned in the direction of the arrow B, a positioning pawl 12 is provided on the upper end of the sidewall of the head cap opposite to the cleaning roll 7, as shown in FIG. 3. This positioning pawl 12 is retained by the lower side edge of the ink cartridge 3 for positioning the head cap 5.

In the vicinity of the longitudinal sidewall towards the print head 4 of the head cap 5, the columnar-shaped cleaning roll 7 is detachably mounted so as to be contacted with the ink emitting surfaces 6 of the print head 4 over the entire length thereof. On each end of the cleaning roll 7 is formed a pin 9, as shown in FIG. 4, this pin 9 being protruded and held by a substantially U-shaped upstanding holding member 10, as shown in FIG. 3. An upper pin-receiving portion of the holding member 10 may be elastically opened and closed, such that, by thrusting the pin 9 against the pin-receiving portion from above, the pin-receiving portion is opened to receive the pin 9, with the pin-receiving portion then being closed to hold the pin. If conversely the pin 9 is hoisted, the pin-receiving portion is opened to allow the dismounting of the pin 9.

Figure 4:
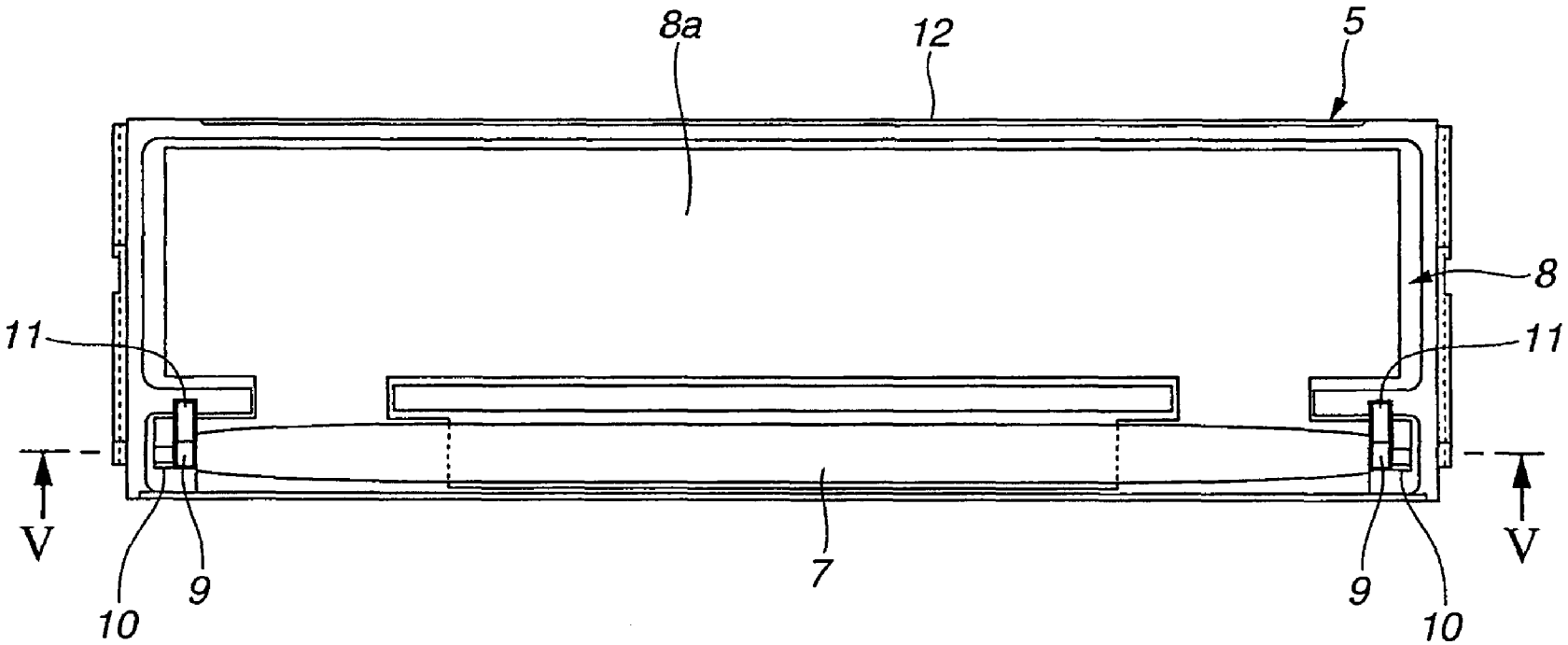
FIG. 4 is a plan view showing the specified examples of a head cap, a cleaning roll and an ink reservoir.
Figure 5:
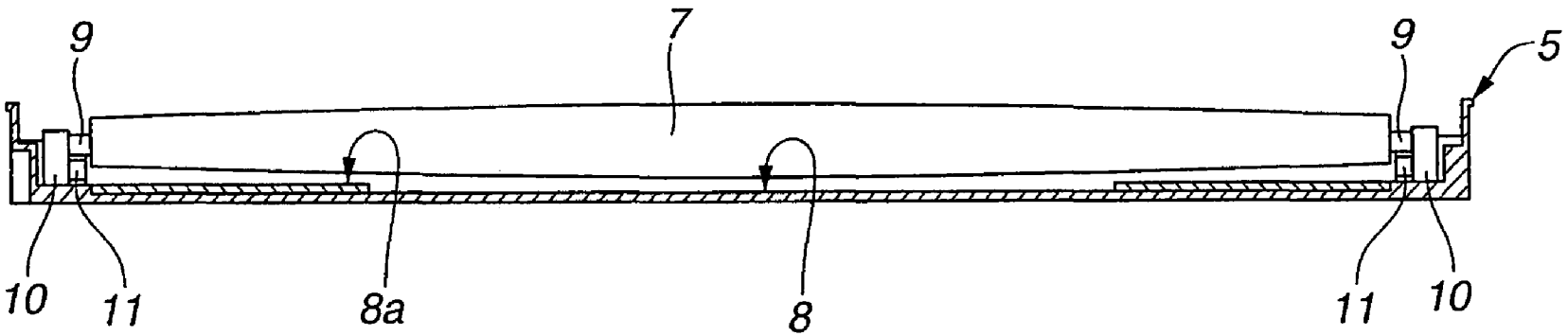
FIG. 5 is a cross-sectional view taken along line V-V of FIG. 4.

Meanwhile, the columnar shape of the cleaning roll 7 is designed to present a so-called crown shape in which a longitudinal center portion thereof bulges out moderately as shown in FIGS. 4 and 5. The reason for this is that the longitudinal center portion of the cleaning roll 7 tends to be flexed downward and hence it is necessary to prevent the cleaning roll from becoming detached out of contact with the ink emitting surfaces 6.

The portion of the cleaning roll 7 contacted with the ink emitting surfaces 6 is formed of rubber or the like elastic material. That is, although the core material of the cleaning roll 7 is metal or hard resin, the peripheral portion thereof on the outer side of the core material is formed of rubber or the like elastic material. However, the cleaning roll 7 may be formed in its entirety of rubber or the like elastic material.

A floating spring 11 is interposed in a location between the cleaning roll 7 and the head cap 5 where the cleaning roll is held by the head cap, as shown in FIG. 3. This floating spring 11, operating as a means for biasing the cleaning roll 7 towards the ink emitting surfaces 6 of the print head 4, is, for example, a spring plate substantially U-shaped when seen in a side view and which is introduced to a site below the pin 9 in the vicinity of the holding member 10. The biasing force of the floating spring 11 acts on each of the pins 9 for thrusting the cleaning roll 7 towards the ink emitting surfaces 6 of the print head 4 with an approximately equal force. Thus, as the head cap 5 is mounted to the bottom side of the ink cartridge 3, as shown in FIG. 2, the cleaning roll 7 is brought into physical contact with the ink emitting surfaces 6 of the print head 4 over the entire length of the ink emitting surface by virtue of the biasing force of the floating spring 11, the elastic force of the cleaning roll 7 and the crown shape of the cleaning roll. Meanwhile, the floating spring 11 is not limited to the substantially U-shaped plate spring and may also be a coil spring.

The cleaning roll 7 is run in rotation by contact thereof with the ink emitting surfaces 6 of the print head 4. Thus, as the head cap 5 is moved in the direction of arrow A, as shown in FIG. 2, the cleaning roll 7 is rotated by being tightly contacted with the ink emitting surfaces 6 of the print head 4, over the entire length thereof, with a moderate pressure, to remove the ink affixed to the ink emitting surfaces 6 by rotational movement of the cleaning roll 7.

Figure 6A:
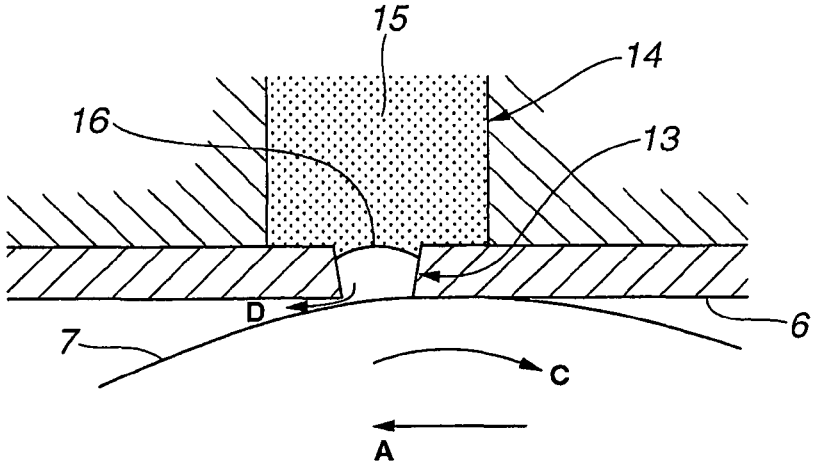
FIGS. 6A to 6C are enlarged cross-sectional views for illustrating the cleaning operation of the ink emission surface of the print head by the cleaning roll.
Figure 6B:
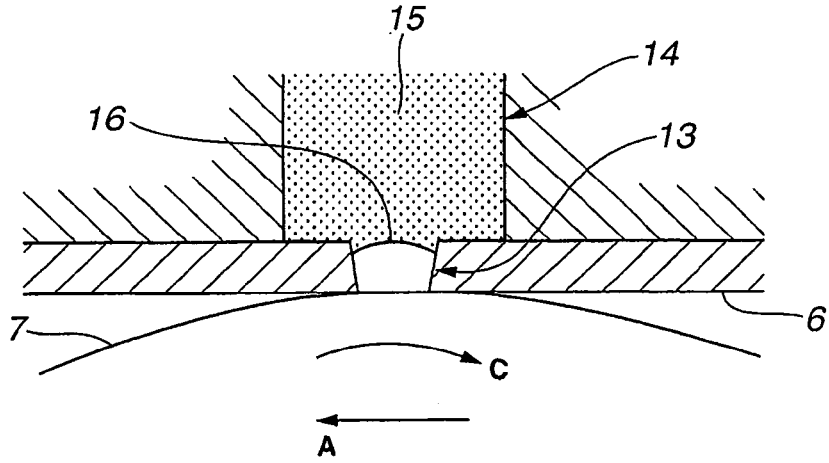
Figure 6C:
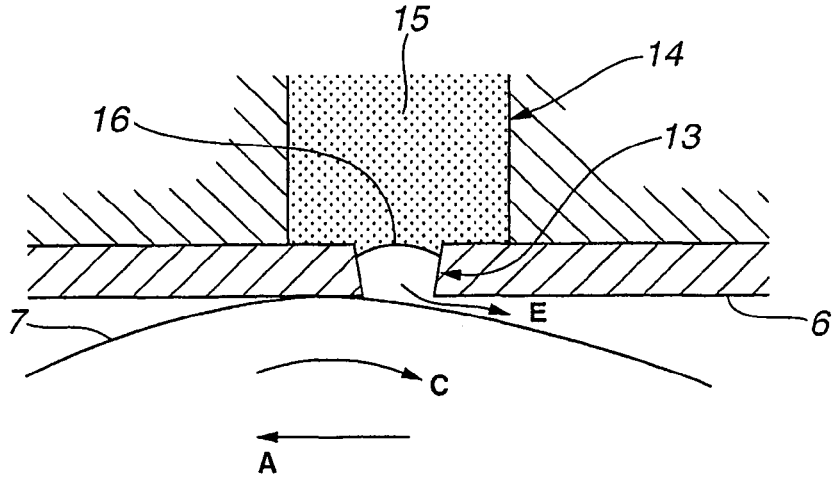

The cleaning operation of the ink emitting surfaces 6 of the print head 4 by cleaning roll 7 is now explained with reference to FIGS. 6A to 6C. In FIGS. 6A to 6C, the ink emitting surfaces 6, ink emitting opening 13 and the cleaning roll 7 are shown in enlarged cross-sectional views for explanation. First, in FIGS. 6A to 6C, the cleaning roll 7 is passively rotated along the direction of arrow C by contact with the ink emitting surfaces 6, as the cleaning roll is moved along the direction of arrow A along with the head cap 5 shown in FIG. 2. It is now assumed that the cleaning roll 7 travels past the location of the ink emitting openings 13 of a certain column in a given one of the ink emitting surfaces 6 of the print head 4 shown in FIG. 2.

FIG. 6A shows the state in which the cleaning roll 7, having moved along the direction of arrow A as it is passively run in rotation along the direction of arrow C, has reached the position of the ink emitting opening 13 of a given column. At this time, ink 15 from an ink chamber 14 is charged in the ink emitting opening 13, and a meniscus 16 of a concave surface is formed within the ink emitting opening 13 under surface tension of the ink 15. Referring to FIG. 6A, when the cleaning roll 7 is moved along the direction of arrow A, as it is passively rotated along the direction of arrow C, the ink emitting opening 13 is progressively stopped from one side edge towards the other side edge thereof. In the interim, air within the ink emitting opening 13 is pushed out along the direction of the arrow D via a gap on the other side edge.

Then, referring to FIG. 6B, when the cleaning roll 7 is further moved along the direction of arrow A as being passively rotated along the direction of arrow C and reaches the location of the ink emitting opening 13, the ink emitting opening 13 is completely stopped. The cleaning roll 7 at this time is thrust against and contacted with the ink emitting surfaces 6, so that, microscopically, the surface of the cleaning roll 7 is partially intruded by elasticity into the ink emitting opening 13 between one side edge and the opposite side edge of the ink emitting opening 13 to stop up the entrance to the ink emitting opening 13 to hermetically seal the inside as the cleaning roll has extruded air from within the ink emitting opening 13.

Subsequently, the cleaning roll 7 is further moved along the direction of arrow A, as it is passively rotated along the direction of arrow C, so as to open the one side edge of the ink emitting opening 13, with the other side edge thereof remaining stopped, as shown in FIG. 6C. At this time, microscopically, when the portion of the surface of the cleaning roll 7, slightly intruded into the inside of the ink emitting opening 13, clears the one side edge of the ink emitting opening 13, the air hermetically enclosed within the ink emitting opening 13 is drawn out along the direction of the arrow E via a gap in the one side edge of the ink emitting opening.

That is, due to changes in the pressure in the ink emitting opening 13 produced on transition from the state in which the air in the ink emitting opening 13 is pushed out in a minor quantity and the ink emitting opening is hermetically sealed (positive pressure) as shown in FIG. 6B to the state in which the air in the ink emitting opening 13 is drawn out (negative pressure) as shown in FIG. 6C, the ink in the ink emitting opening 13 is sucked. This produces the force of suction of drawing the ink left in the ink emitting opening 13 to outside the print head 4 in FIG. 2, so that the ink within the ink emitting opening 13 is sucked and removed positively.

In this case, since the cleaning roll 7 formed of rubber or the like elastic material is moved on the ink emitting surfaces 6, the ink emitting surfaces 6 may be cleaned without damaging the protective layer which covers up a head electrode of the ink emitting surfaces 6.

In the foregoing explanation, the cleaning roll 7 is passively rotated by physical contact thereof with the ink emitting surfaces 6 of the print head 4. Alternatively, the cleaning roll 7 may remain fixed due to contact state thereof with the ink emitting surfaces 6. For example, rotation of the cleaning roll 7 may be prohibited by providing two pins 9 on both ends of the cleaning roll 7 for extending in the up-and-down direction and by introducing the two pins in the substantially U-shaped groove formed in the holding member 10. Since the surface of the ink emitting surfaces 6 are scraped by the moving cleaning roll 7, not only the liquid ink affixed to the ink emitting surfaces 6 but the ink which has become solidified and caked to the ink emitting surface may also be removed.

The cleaning roll 7 may also be rotated at a speed restricted by a braking mechanism and is rubbed against the ink emitting surfaces 6 of the print head 4. The braking mechanism may be implemented by pressing a pin 9 on each end of the cleaning roll 7 in an opening bored in a elastic member interposed between the pin and the holding member 10 holding the pin 9, as shown for example in FIG. 3, or by pressure contacting both end faces of the cleaning roll 7 with the lateral sides of the elastic member, thereby generating a suitable braking power during rotation of the cleaning roll 7. Since the surface of the ink emitting surfaces 6 is scraped by the rotating cleaning roll 7, not only the liquid ink affixed to the ink emitting surfaces 6 but the ink which has become solidified and caked to the ink emitting surface may also be removed without damaging the ink emitting surfaces 6.

On an ink receiving bottom surface of the ink reservoir 8 within the inner side of the head cap 5 is laid an ink absorbing member 8*a*, as shown in FIGS. 3 to 5. This ink absorbing member 8*a* operates as a means for preventing splashing of the ink preliminarily emitted from the print head 4. This ink absorbing member 8*a*, formed of a porous high molecular material, such as sponge, polyurethane or foamed polyurethane, is laid on substantially the entire surface of the receiving surface of the ink reservoir 8. The ink absorbing member 8*a* is not provided below the center large-thickness portion of the crown-shaped cleaning roll 7 in order to provide a clearance space, as shown in FIG. 5.

By providing the ink absorbing member 8*a* as described above, it is possible to prevent the splashing of the ink preliminarily emitted from the print head 4 shown in FIG. 2, as well as to prevent the ink from becoming accumulated in the ink reservoir 8 by absorbing the emitted ink. Consequently, the ink preliminarily emitted may be prevented from splashing from the ink reservoir 8 to become re-deposited on the ink emitting surfaces 6. The ink absorbing member 8*a* which has been in use for some time and which has absorbed the preliminarily emitted ink duration may be dismounted readily from the ink reservoir 8 and discarded, then a new substitute ink absorbing member 8*a* may be laid by way of cleaning by removing the preliminarily emitted ink.

In the example shown in FIGS. 3 to 5, the bottom surface of the head cap 5 in its entirety is the ink reservoir 8. However, the present invention is not limited to this and only a portion of the bottom surface of the head cap may be formed as the ink reservoir 8. For example, in FIG. 2, the cleaning roll 7 may be shifted slightly towards the center, and a partitioning wall may be provided between the cleaning roll 7 and the sidewall of the head cap 5 towards the cleaning roll 7, with a chamber surrounded by the partitioning wall and the sidewall then being used as the ink reservoir 8. In such case, the site for receiving the ink preliminarily emitted from the ink emitting opening in the print head 4 may be restricted to a specified location of the head cap 5.

The preliminary emission of the ink from the ink emitting opening in the print head 4 is now explained. The preliminary emission of the ink is performed by discharging the ink in the ink emitting opening by e.g. suction prior to text printing or image printing, in order to prevent the ink in the ink emitting opening from becoming vaporized and dried. It is noted that, if the ink in the ink emitting opening is vaporized and dried in this manner, it is increased in viscosity and solidified, such that difficulties are encountered in emitting the ink in the usual manner. This preliminary emission of the ink is caused to take place from the ink emitting opening towards the ink reservoir 8 in the head cap 5 following the cleaning of the ink emitting surfaces 6 by the cleaning roll 7. For example, the ink drops are emitted from the ink emitting opening of the print head 4 at a frequency of the order of 10 kHz, this emission of the ink droplets being repeated several times by way of performing the preliminary emission.

If, in FIG. 2, the preliminary emission of the ink is performed following the cleaning of the ink emitting surfaces 6 of the respective colors, in order to prevent color mixing caused by cleaning the ink emitting surfaces 6 of the respective colors with the sole cleaning roll 7, it is necessary to control the timing of the preliminary ink emission.

To this end, the head cap 5 is provided with a means for detecting the timing of the preliminary ink emission from ink emission openings in the print head 4 when the head cap 5 is moved relative to the print head 4, as shown in FIG. 7. Meanwhile, in FIG. 7, the direction of the movement of the head cap 5 is reversed from that in FIG. 2.

In FIG. 7, the means for detecting the timing of the preliminary emission is made up by a position detection sheet 17, provided to the lower surface of the head cap 5, and a photo-electrical switch 18 provided within the main body unit of the printer 2 for facing this position detection sheet 17. This position detection sheet 17 is used for checking into the positions of correspondence of the head cap 5 to the ink emitting surfaces 6 of the respective colors of the print head 4 when the head cap is moved along the direction of the arrow A. For example, a light/dark pattern is formed in keeping with the arraying pitch of the ink emitting surfaces 6 of, for example, Y, M, C and K, with the array of the pattern being reversed in the direction thereof from the sequence of the respective colors Y, M, C and K of the ink emitting surfaces 6. Moreover, in the initial state of movement of the head cap 5, the array of the pattern of the position detection sheet 17 is shifted backward relative to the direction of arrow A.

The photo-electrical switch 18 detects the light/dark pattern of the position detection sheet 17, moved along with the head cap 5, and is made up by a light radiating unit 18*a* formed e.g. by a light emitting diode (LED), and a light receiving detecting unit 18*b* formed by a photodiode, with the light radiating unit 18*a* and the light receiving detecting unit 18*b* being unified together. The light/dark pattern of the position detection sheet 17 produces changes in the reflectance with respect to the wavelength of the light radiated from the light radiating unit 18*a*, with the light receiving detecting unit 18*b* being sensitive to the wavelength of the reflected light.

In the above structure, if, when the head cap 5 is moved along the direction of arrow A in FIG. 7, the position detection sheet 17 provided to the lower surface of the head cap 5 travels past the front side of the photo-electrical switch 18, the light/dark pattern of the position detection sheet 17 is detected to check into the positions of correspondence with the ink emitting surfaces 6 of Y, M, C and K. In this manner, the position of the cleaning roll 7, moved along with the head cap 5, may be known, and the timing control is performed in such a manner that the preliminary ink emission through the ink emission openings is sequentially carried out directly after the cleaning of the ink emitting surfaces 6 of the respective colors by the cleaning roll 7. At this time, the preliminarily emitted ink is positively received within the ink reservoir 8.

FIGS. 8A and 8B are schematic views for illustrating a modification of the cleaning roll 7. In this modification, the cleaning roll 7 is run in rotation in the forward direction or in reverse by a rotational driving unit. That is, referring to FIG. 2, an output shaft of a motor, not shown, provided within the main body unit of the printer 2, is coupled to the pin 9 of the cleaning roll 7, via a gearing of an optional reduction ratio, for positively rotationally driving the cleaning roll 7.

Referring to FIG. 8A, the cleaning roll 7 is run in rotation by the motor in the same direction as the movement direction along the direction of arrow A in FIG. 7 of the head cap 5, at an rpm such that the peripheral speed $v_2$ of the cleaning roll 7 is higher than the movement speed $v_1$ of the head cap 5. In this case, there results the scrubbing due to the difference in the speed between the ink emitting surfaces 6 of the print head 4 and the outer periphery of the cleaning roll 7, thereby positively cleaning the ink emitting surfaces 6. In the case where the motor is run in rotation with an rpm such that the movement speed $v_1$ of the head cap 5 is larger than the rpm of the peripheral speed $v_2$ of the cleaning roll 7, there again results the scrubbing due to the difference in the speed between the ink emitting surfaces 6 of the print head 4 and the outer periphery of the cleaning roll 7, thereby positively cleaning the ink emitting surfaces 6.

Alternatively, as shown in FIG. 8B, the cleaning roll 7 may be run in rotation in a reverse direction to the direction of movement along arrow A of the head cap 5 shown in FIG. 7. In this case, there results the scrubbing due to the difference in the movement direction between the ink emitting surfaces 6 of the print head 4 and the outer periphery of the cleaning roll 7, thereby positively cleaning the ink emitting surfaces 6. Thus, in the cases shown in FIGS. 8A and 8B, the ink emitting surfaces 6 of the print head 4 are cleaned by new zones of the outer peripheral surface of the cleaning roll 7, presented one after another due to positive rotation of the cleaning roll 7.

Figure 9:
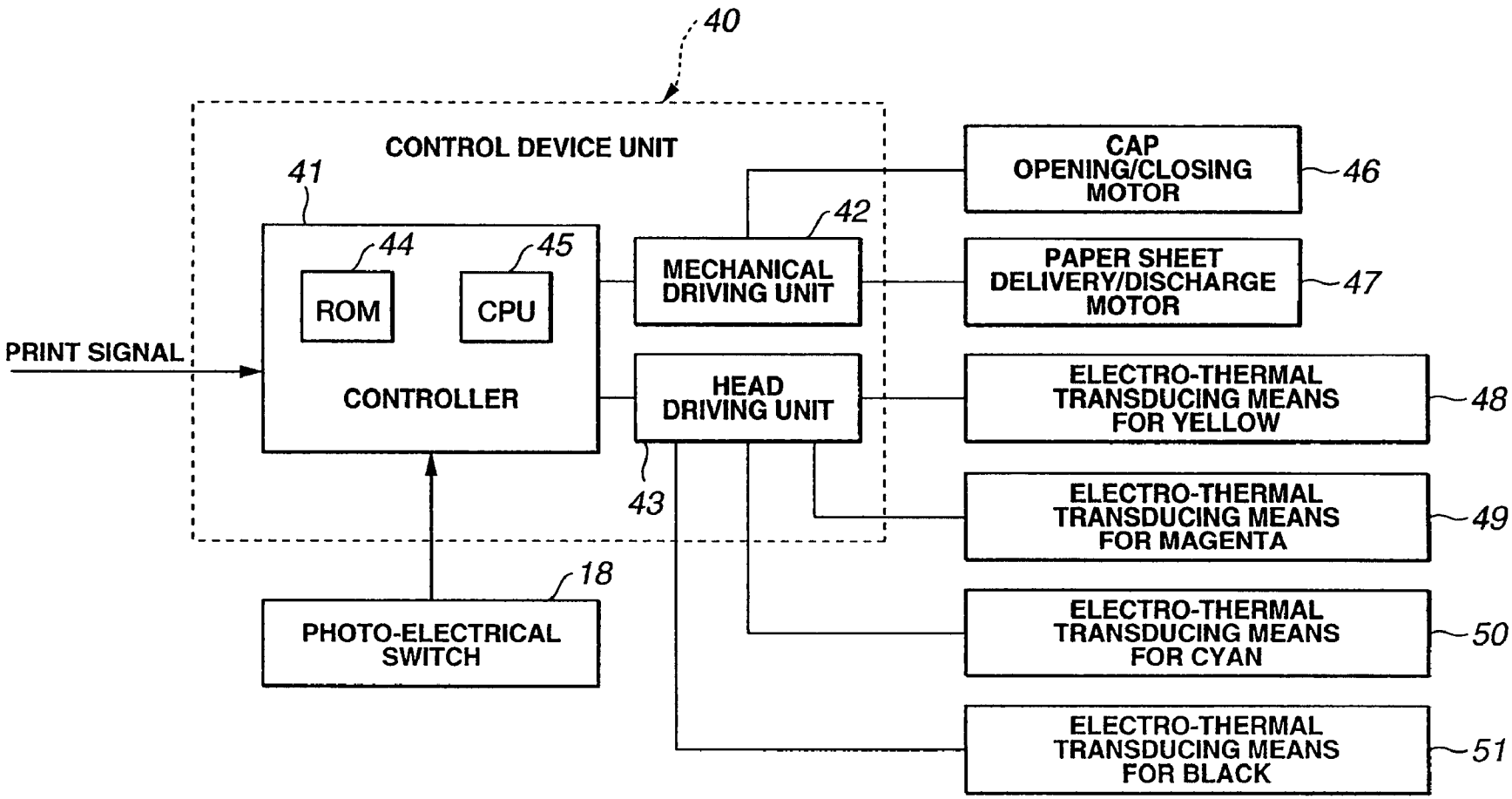
FIG. 9 is a block diagram for illustrating the structure and the operation of a controlling device designed for controlling the image forming apparatus according to the present invention.

FIG. 9 is a block diagram for illustrating the structure and the operation of a control device unit 40 for controlling the image forming apparatus designed and constructed as described above. This control device unit 40 controls the driving of the movement means for the head cap 5, having the cleaning roll 7 housed therein, or controls the ink emission from the ink emitting openings in the print head 4, and includes a controller 41, a mechanical driving unit 42 and a head driving unit 43.

The controller 41 forms driving control means for controlling the driving of a cap opening/closing motor 46, adapted for opening/closing the head cap 5, and emission control means for controlling the ink emission operation from the ink emitting openings. The controller 41 includes, in the inside thereof, a ROM 44 for storage therein of a variety of the information or control programs, and a CPU 45 for sending out a variety of control commands, based on the control program read out from the ROM 44, and is designed to control the mechanical driving unit 42 and the head driving unit 43, which will be explained subsequently.

The controller 41 includes a detection means for detecting e.g. the information on the amount of ink emitted last time from the respective ink emitting openings, image signals or the colors of the emitted inks, which information is contained in a print signal as an image signal including a signal indicating the color of a pixel associated with each ink emitting opening, a signal indicating the amount of the emitted ink or a signal for selecting the ink emitting openings. Based on the above information, the detection means verifies the amount of preliminary ink emission from each ink emitting opening, as well as the color of the preliminarily emitted ink, that is, the particular ink emitting openings used for the preliminary ink emission. The controller 41 includes emission controlling means for driving electro-thermal transducing means 48 to 51 for respective colors of the inks charged in the respective ink tanks for controlling the ink emission. The emission controlling means sends signals corresponding to the results of decision by the detection means to the head driving unit 43 which will be explained subsequently.

The mechanical driving unit 42 actuates a cap opening/closing motor 46 for opening/closing the head cap 5 and a paper sheet delivery/discharge motor 47 for delivery and discharge of a paper sheet as a recording medium. The cap opening/closing motor 46 operates as a movement means for causing relative movement of the outer peripheral surface of the cleaning roll 7 and the ink emitting surfaces 6 of the print head 4 as the two are physically contacted with each other.

The head driving unit 43 actuates a device unit adapted for emitting the ink from the ink emitting openings formed in the ink emitting surfaces 6 of the print head 4, and sends driving signals to an electro-thermal transducing means for yellow 48, an electro-thermal transducing means for magenta 49, an electro-thermal transducing means for cyan 50 and an electro-thermal transducing means for black 51, each formed by, for example, a heating resistor.

The control device unit 40, constructed as described above, performs control in such a manner that the controller 41 takes in the print signal, representing the operation for image forming from outside, and is supplied with a detection signal from the photo-electrical switch 18 of FIG. 7 indicating the positions of registration with the ink emitting surfaces 6 of the respective colors to send driving signals to the mechanical driving unit 42 and to the head driving unit 43 to permit the cleaning roll 7 to cause preliminary emission of the inks in the sequence of yellow, magenta, cyan and black, into the head cap 5 sequentially beginning from the column of the ink emitting openings in the ink emitting surfaces 6 first traversed by the cleaning roll 7.

Figure 10:
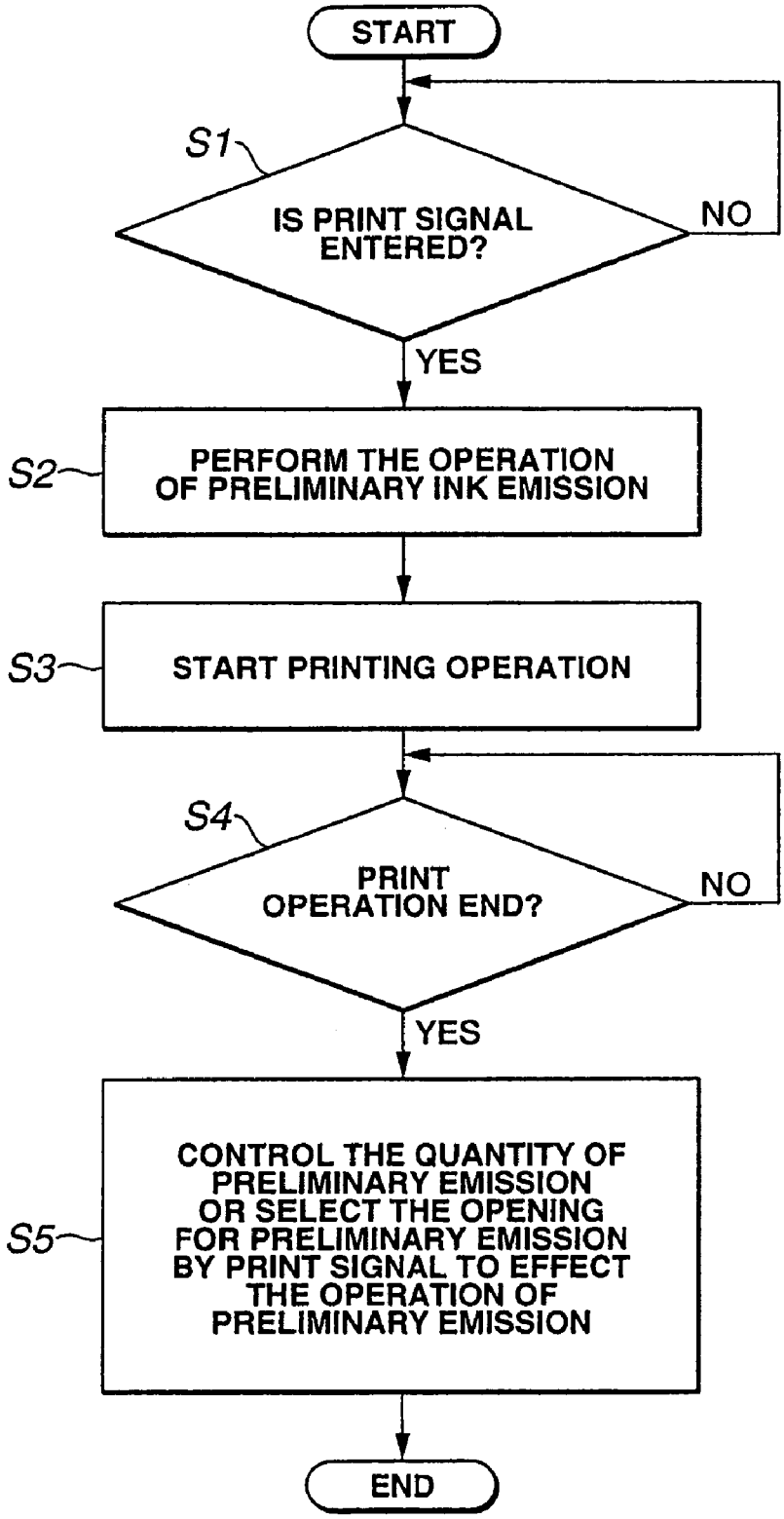
FIG. 10 is a flowchart showing the controlling method for the image forming apparatus according to the present invention, and mainly showing the control of the operation of the preliminary ink emission.

FIG. 10 is a flowchart showing the control method for controlling the above-described image forming apparatus, and mainly shows the control for the operations of preliminary ink emission from the ink emitting openings in the print head 4. Meanwhile, this control is performed by instructions from the CPU 45, based on a control program stored in the ROM 44 within the controller 41 shown in FIG. 9.

When the job shown in FIG. 10 is started and, when the print signal indicating the start of the operation of forming an image is supplied to the controller 41 shown in FIG. 9, the controller 41 in a step S2 sends an emission trigger signal to the head driving unit 43 for driving the electro-thermal transducing means 48 to 51 of the respective colors. The head driving unit 43 sends electrical signals to the electro-thermal transducing means 48 to 51 of the respective colors to perform the preliminary ink emitting operations. Meanwhile, the step S2 preliminarily emits the ink prior to start of the print operation and hence may be omitted.

It should be noted that the preliminary ink emission plays a crucial role in preventing the ink in the ink emitting openings from becoming thickened and solidified to a high viscosity, as described above. That is, if the ink is accumulated within the ink emitting openings and solidified to a high viscosity, the ink cannot be emitted smoothly during printing. In case the ink is accumulated and solidified in this manner to an extreme degree, the result is ink clogging. Thus, the cleaning of the inside of the ink emitting openings by the preliminary ink emission performs the role of cleaning the ink emitting openings and the vicinity thereof by the cleaning roll 7 shown in FIG. 6 and preventing the ink clogging.

In the control device unit 40, shown in FIG. 9, the print signal, indicating the start of the image forming operation, is supplied to the controller 41, and subsequently the ink is preliminarily emitted from the ink emitting openings, such that the thickened or solidified ink of high viscosity, left in the vicinity of the ink emitting openings, used until the last ink emitting operation, is blown off to outside via the ink emitting openings. This blow-off operation represents the operation of cleaning the ink emitting openings in preventing the ink thickened or solidified to a high viscosity from filling up the ink emitting openings to permit subsequent smooth ink emission through the ink emitting openings. In this manner, the subsequent printing operation, that is, the operation of emitting the ink, may be performed efficiently.

After the preliminary ink emission of step S2, shown in FIG. 10, the printing operation, that is, the operation of ink emission through the ink emitting openings, is performed in a step S3. Then, processing transfers to a step S4. Until the photo-electrical switch 18 shown in FIG. 9 detects a print operation end signal, the "NO" branch of the step S4 is followed, such that the respective ink emitting openings continue to perform the ink emitting operation, based on the print signal. When the photo-electrical switch 18 shown in FIG. 9 detects a signal indicating the end of the print operation, the "YES" branch of the step S4 is followed, such that a signal indicating the end of printing is sent from the photo-electrical switch 18 to the controller 41.

In a step S5 shown in FIG. 10, the amount of the preliminary ink emission through the respective ink emitting openings by the print signal is controlled, by a means provided in the controller 41 for calculating the amount of the preliminary ink emission, or by a means for deciding on the ink emitting openings used for preliminary emission. Alternatively, the ink emitting openings, via which the ink is to be preliminarily emitted, are selected, and the signals indicating the amounts of preliminary emission of the respective inks are sent to the so selected ink emitting openings, which then perform the preliminary ink emitting operations. The job is finished when the operation of the preliminary ink emission, shown in a step S5, has come to a close.

In the foregoing explanation, it has been presupposed that the print signal is detected by the controller 41. The present invention is not limited to this embodiment and the print signal may also be detected by the head driving unit 43. In this case, the head driving unit 43 is provided with a means for calculating the amount of the preliminary ink emission by the print signal or a means for deciding on the particular ink emitting openings for preliminary ink emission by the print signal. These means control the amount of the preliminary ink emission for the respective ink emitting openings by the print signal, or select the ink emitting openings for the preliminary ink emission by the print signal, to send signals indicating the amounts of the preliminary emission of the respective inks to the selected ink emitting openings to permit the ink to be emitted to the so selected ink emitting openings.

The print signal may be provided with an identifier for discriminating the amounts of the ink emission or the ink colors. In this case, a signal indicating the pixel color associated with the ink emitting openings, a signal indicating the amounts of the ink emission or a signal for selecting the ink emitting openings is contained in the print signal. In this manner, the amount of the preliminary ink emission may be controlled by the print signal, or the ink emitting openings for preliminary ink emission may be selected by the print signal, in the step S5 of FIG. 10, to perform the operation of the preliminary ink emission.

In the foregoing explanation, the print signal in the step S5 of FIG. 10 is output just before the preliminary ink emission. The present invention is not limited to this and the amount of the preliminary ink emission through the ink emitting openings to be started next may be controlled based on the amount of the ink emitted during the past printing operation. With this type of the image forming apparatus and the controlling method therefor, in which the total amounts of emission of the inks of the respective colors through the ink emitting openings during the past several printing or ink emitting operations, for example, can be detected, the amounts of the preliminary ink emission from the ink emitting openings of the respective colors, calculated based on the total amounts of emission of the inks of the respective colors, may be determined, and the signals indicating the so determined amounts of the preliminary ink emission from the ink emitting openings of the respective colors may be transmitted to the emission control means provided to the controller 41 or to the head driving unit 43 shown in FIG. 9. The signals indicating the amounts of the preliminary emission through the ink emitting openings of the respective colors, sent to the controller 41, are sent to the head driving unit 43. The signals indicating the amounts of the preliminary emission through the ink emitting openings of the respective colors are transmitted from the head driving unit 43 to the electro-thermal transducing means 48 to 51 of the respective colors such that preliminary ink emission is carried out in preliminary amounts of emission which are based on the total amounts of several latest past emissions of the inks of the respective colors through the ink emitting openings.

In the step S5 shown in FIG. 10, the signal for preliminary emission, output from the CPU 45, operating as the emission controlling means in the controller 41 shown in FIG. 9, may be set in relation to the time elapsed as from the time of the last emission. In this case, a time signal detection means, provided to the controller 41, detects a signal portion in the image signal, input last time, which signal portion indicates the time of transmission of the electrical pulses sent to the electro-thermal transducing means 48 to 51 of the respective colors by which the ink was emitted last time. The time signal detection means detects the time closest to the current time when the inks were emitted through the respective ink emitting openings for printing, and calculates the time difference between the time of emission and the current time. The time signal detection means then sets a longer preliminary emission time or a larger amount of preliminary ink emission for the ink emitting openings with a larger difference from the current time. The longer the time the ink emitting opening has not been used recently, the more likely is the ink thickened or solidified to a high viscosity left therein. This thickened or solidified ink can be blown off by the efficient preliminary ink emission.

Moreover, the control of the amount of the preliminary ink emission during the operation of the preliminary emission in the step S5 in FIG. 10 may be determined by the number of electrical pulses supplied to the electro-thermal transducing means in the ink tank charged with the ink. These electrical pulses are generated by the electrical pulse generating means provided in the controller 41 shown for example in FIG. 9 and are sent to the head driving unit 43 and thence to the electro-thermal transducing means 48 to 51 of the respective colors for emission of the respective color inks. The electrical pulse generating means may not only be used for preliminary emission of the respective color inks but may be the same as the electrical pulse generating means used for ink emission during printing. This eliminates the necessity for providing two electrical pulse generating means, namely the electrical pulse generating means for printing and the electrical pulse generating means for preliminary ink emission, thus achieving a higher space efficiency of an integrated circuit unit.

Moreover, in the step S5 shown in FIG. 10, the ink jet head 1, shown in FIG. 1, may emit the inks of respective colors, including yellow, magenta, cyan and black, from the ink emitting openings of the ink emitting surfaces, while the emission control means may control the amounts of the preliminary ink emission depending on the colors of the inks emitted from the ink emitting openings. By so doing, the amounts of the preliminary ink emission or the time duration of the preliminary ink emission may be varied depending on whether the ink exhibits good drying properties or poor drying properties, such that the thickened or solidified ink may be blown off by efficient preliminary ink emission.

In particular, the amounts of the preliminary ink emission at this time are preferably set so that the black ink may be preliminarily emitted in a larger quantity than the other inks. The reason is that the black ink has such properties that the quantity of the dyestuff material added is larger, the molecular weight of the dyestuff is higher and the viscosity is higher than those of the other color inks, that is, the inks of yellow, magenta or cyan, and hence the quantity of the preliminary ink emission through the black ink emitting openings must be larger and the time for preliminary emission the black ink must be longer. Of course, the longer the preliminary ink emission time duration, the larger is the quantity of the preliminary ink emission. On the other hand, in the color inks of yellow, magenta or cyan, there is a difference in the drying performance, depending on the content as well as the molecular weight of the dyestuff, such that an efficient preliminary ink emission operation may be achieved as to the quantity or the time of the preliminary ink emission, by taking the drying performance into account.

The image forming apparatus of the present invention may be provided with a head cap 5, having housed therein the cleaning roll 7 of an elastic material of a columnar shape as shown in FIG. 2 and adapted for protecting the ink emitting surfaces 6 of the print head 4. The image forming apparatus of the present invention may further be provided with the mechanical driving unit 42 (see FIG. 9) as movement means for causing relative movement between the cleaning roll 7 and the print head 4. By so doing, the cleaning roll 7 may be housed within the head cap 5, while the ink emitting surfaces of the print head 4 may be protected by the head cap and the relative movement between the cleaning roll 7 and the ink emitting surfaces may be achieved by the opening movement of the head cap 5. The thickened ink in the ink emitting openings may be sucked and removed by elastic deformation of the cleaning roll 7 during this movement.

At this time, the cleaning of the ink emitting openings by the cleaning roll 7 is pre-set to occur before or after the preliminary ink emission. In particular, if the cleaning of the ink emitting openings by the cleaning roll 7 is pre-set to occur directly after the operation of the preliminary ink emission, the ink left in the vicinity of the ink emitting openings as a result of the preliminary emission may be removed by the cleaning roll 7 so that the ink emitting surfaces 6 can be cleaned efficiently. If the cleaning of the ink emitting openings by the cleaning roll 7 is pre-set to occur just before the operation of the preliminary ink emission, the thickened or solidified ink left within the ink emitting openings may be removed to enable smooth subsequent preliminary ink emissions.

If, in the step S5 shown in FIG. 10, the photo-electrical switch 18 shown in FIG. 9 detects the cleaning by the cleaning roll 7, which then sends out a signal indicating such detection to the controller 41, an emission controlling means, provided in the controller 41, may control the quantity or time of the preliminary ink emission, or select the ink emitting openings via which to emit the inks, as the cleaning time by the cleaning roll 7 and the time the ink emitting openings emitted the ink last time or in the past, in the sent signal, are taken into account. For example, if, in the step S5, the time of cleaning by the cleaning roll 7 in the past not just before the operation of the preliminary ink emission is close to the current time, the quantity of the preliminary ink emission may be decreased, or the time of the preliminary ink emission may be shortened, thereby improving the efficiency in preliminary ink emission.

In the above explanation of the cleaning operation by the cleaning roll 7, the operation of the preliminary ink emission is performed after the cleaning of the ink emitting surfaces 6 of the print head 4. However, if there is no fear of color mixing by the cleaning roll 7 contacted with the ink emitting surfaces 6, the preliminary ink emission may be carried out before cleaning of the ink emitting surfaces 6 by the cleaning roll 7. In this case, it is unnecessary to control the timing of the preliminary emission from the ink emitting openings of the inks of the respective colors of Y, M, C and K by e.g. the photo-electrical switch 18 shown in FIG. 9.

Referring to FIGS. 11A to 11H, a series of the cleaning operations by the above-described image forming apparatus are now explained. It is assumed here that, in the ink jet head 1, shown in FIG. 2, the head cap 5 is moved along the direction of arrow A to clean the ink emitting surfaces 6 of the print head 4 and, after such cleaning, the ink is emitted preliminarily.

Figure 11A:
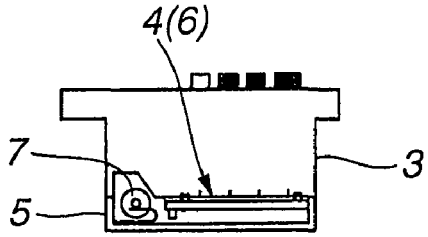
FIGS. 11A to 11H illustrate the cleaning operation by the cleaning roll and the head cap of the ink jet head.
Figure 11B:
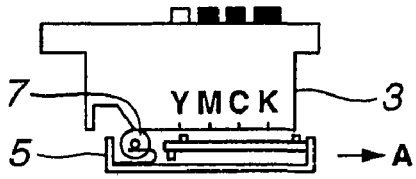

First, FIG. 11A shows an initial state in which the head cap 5 is closed against the ink cartridge 3. In this state, the ink jet head 1 is housed and set within the main body unit of the printer 2. Then, as the head cap 5 is set in the main body unit of the printer 2, the head cap 5 is moved along the direction of the arrow A, relative to the ink cartridge 3, by the head cap open signal, as shown in FIG. 11B. The cleaning roll 7 then is moved along the direction of arrow A, relative to the ink cartridge 3, along with the head cap 5. As the cleaning roll 7 is kept in pressure contact with the ink emitting surfaces 6 of the print head 4, the cleaning roll is passively rotated by physical contact with the ink emitting surfaces 6. Alternatively, the rotation of the cleaning roll 7 is restricted by a fixed member or a braking unit. Still alternatively, the cleaning roll 7 is moved as it is run in rotation in the forward direction or in reverse.

It is now assumed that, in this state, the ink emitting surfaces 6 for yellow Y in the ink emitting surfaces 6 of the print head 4 in FIG. 2 has been cleaned. The portion of the position detection sheet 17 (see FIG. 7), provided on the lower surface of the head cap 5, and which is associated with yellow Y, is moved to the detection position of the photo-electrical switch 18, to detect that the cleaning of the ink emitting surfaces 6 of yellow Y has come to a close. This causes a preliminary emission start signal to be sent from the controller 41 to the head driving unit 43 shown in FIG. 9. That is, a preliminary emission start signal is sent to the column of the ink emitting openings of the ink emitting surfaces 6 (electro-thermal transducing means for yellow 48).

Figure 11C:
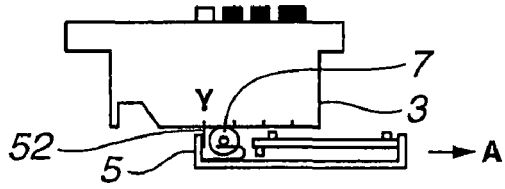
Figure 11D:
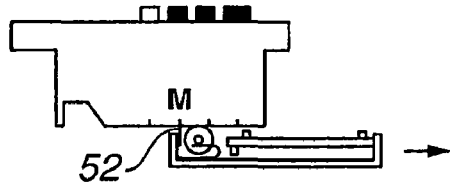
Figure 11E:
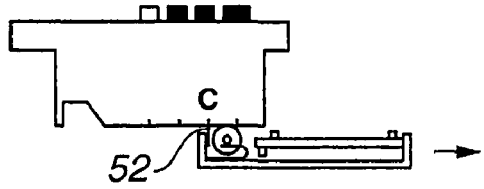
Figure 11F:
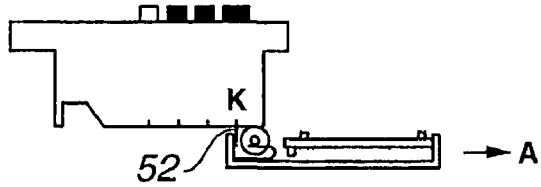

Then, a preliminary emission ink 52 is ejected from the ink emitting openings of the ink emitting surfaces 6 of yellow Y, as shown in FIG. 11C. A preliminary emission stop signal is then sent to the ink emitting openings of the ink emitting surfaces 6 of yellow Y to stop the ejection of the preliminary emission ink 52. In a similar manner, each time the cleaning by the cleaning roll 7 of the ink emitting surfaces 6 of M, C and K sequentially comes to a close, the state of the end of the cleaning of the ink emitting surfaces 6 is detected by the photo-electrical switch 18, and a preliminary emission start signal and a preliminary emission stop signal are sent from the controller 41 to the columns of the respective ink emission openings. This controls the timing of the preliminary ink emission from the columns of the ink emitting openings for the respective colors, so that the ejection of the preliminary emission ink 52 in the sequence of M, C and K, is executed, as shown in FIGS. 11D, 11E and 11F.

Figure 11G:
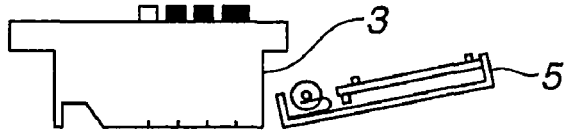

When the cleaning of the ink emitting surfaces 6 of the respective colors and the preliminary emission have come to a close in this manner, the head cap 5 is moved to its full stroke, along the direction of arrow A, and is then moved slightly upward, so as to be set in a receded position, as shown in FIG. 11G. It is in this position that letters or images are printed on the recording sheet.

Figure 11H:
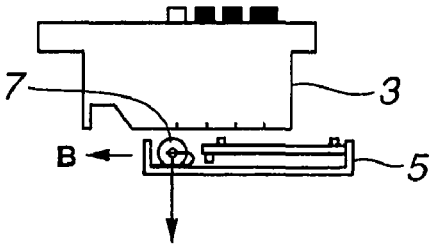

When printing of preset pages of letters or images has come to a close, a head cap close signal is issued, so that the head cap 5 is moved from the aforementioned receded position along the direction of arrow B relative to the ink cartridge 3, as shown in FIG. 11H. The cleaning roll 7 then is moved along the direction of arrow B, relative to the ink cartridge 3, along with the head cap 5, to a closed position, and is thereby reset to the initial state. Meanwhile, when the cleaning roll 7 reverts along the direction of arrow B, the cleaning roll 7 is not contacted with the ink emitting surfaces 6 and hence does not clean these surfaces 6. The image forming apparatus is now in a condition of awaiting the next instructions for printing letters or images.

In the foregoing explanation in connection with FIGS. 11A to 11H, it is assumed that the cleaning roll 7 contacts with and cleans the ink emitting surfaces 6, when the head cap 5 is moved along the direction of arrow A, and that, when the head cap 5 reverts in the direction of arrow B, the cleaning roll 7 is not contacted with the ink emitting surfaces 6. The present invention is not limited to this such that the head cap 5 may be moved along the directions of arrows A and B in a state the cleaning roll 7 is not contacted with the ink emitting surfaces 6. In this case, the ink emitting surfaces 6 are not cleaned by the cleaning roll 7 and only the preliminary ink emission into the inside of the head cap 5 is carried out. Such a sequence may be contemplated in which the preliminary ink emission occurs when the head cap 5 has been restored from the receded position thereof shown in FIG. 11G to the position shown in FIG. 11H, with the head cap 5 being then retreated to the position shown in FIG. 11G.

There may be occasions where the ink is preliminarily emitted when the head cap 5 shown in FIG. 11G is in the receded position, without dependency on the opening/closing operation of the head cap 5, thus the cleaning roll 7 not cleaning the ink emitting surfaces 6.

The overall structure and the operation of the image forming apparatus, for example, an ink jet printer, are now explained with reference to FIGS. 1 and 12 to 18. This ink jet printer emits the ink in a finely divided state from an ink jet head to spray ink dots on the recording sheet to effect printing and, as shown in FIG. 1, includes an ink jet head 1, a main body unit of the printer 2, a head mounting/dismounting unit 19 and a head cap opening/closing unit 20. Meanwhile, the ink jet printer is of the type directly mounting the ink jet head 1 to the main body unit of the printer 2.

The ink jet head 1 is of the type in which the liquid ink is finely divided into droplets by e.g. an electro-thermal transducer or an electro-mechanical transducer to spray the ink dots on the recording sheet, and is formed substantially as explained with reference to FIGS. 1 to 11.

The main body unit of the printer 2 includes the ink jet head 1 loaded in place thereon, in order to demonstrate the function as the ink jet printer, and is provided with a tray for recording sheets, a transport system for the recording sheets, an operation driving system, and an overall control circuit. In FIG. 1, the reference numeral 21 denotes a paper sheet feeder cartridge for supplying the recording sheets and a printed sheet support to which is discharged the printed sheet after printing.

The head mounting/dismounting unit 19 is used for mounting the ink jet head 1 in position within the main body unit of the printer 2 and for dismounting the ink jet head 1 so mounted in position. For example, the head mounting/dismounting unit 19 is a transversely elongated bar member for pressing against the upper surface of the ink jet head 1 inserted in e.g. a center recess in the main body unit of the printer 2. That is, the head mounting/dismounting unit is provided extending in the width-wise direction of the main body unit of the printer 2 and is adapted for being set to a vertically upstanding position or being in a horizontally leveled down position. When the bar member is in the vertically upstanding position, as shown in FIG. 1, the ink jet head 1 is moved in the direction of arrow H and housed in position. When the bar member is in the horizontally leveled down position, as shown in FIG. 12, the ink jet head 1 is secured in position.

The head cap opening/closing unit 20 causes relative movement of the head cap 5 with respect to the print head 4 (see FIG. 2), as the ink jet head 1 is secured in position in the main body unit of the printer 2, thereby exposing the ink emitting surfaces 6 (see FIG. 2) to outside, while causing the head cap 5 to be closed following the end of the printing. The head cap opening/closing unit 20 is made up by a rack 22 and a pinion 23 provided on the lateral side of the main body unit of the printer 2 for meshing with the rack 22. On the inner lateral surface of the rack 22 is formed a pin-like projection engaging in a recess formed in the corresponding outer lateral surface of the head cap 5.

Figure 12:
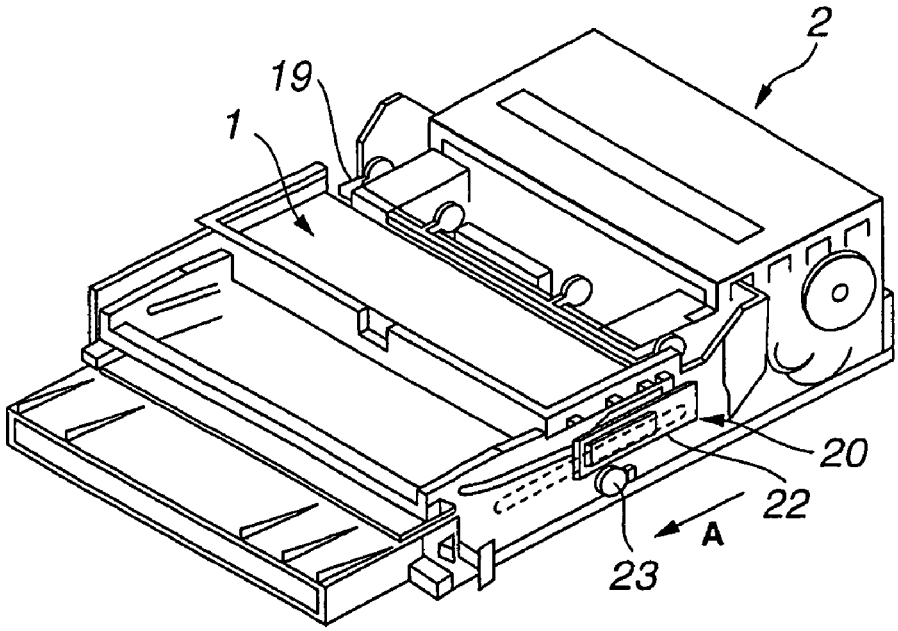
FIG. 12 is a perspective view of an ink jet printer as an example of the image forming apparatus according to the present invention, and specifically showing the state in which the ink jet head has been mounted in position.
Figure 13:
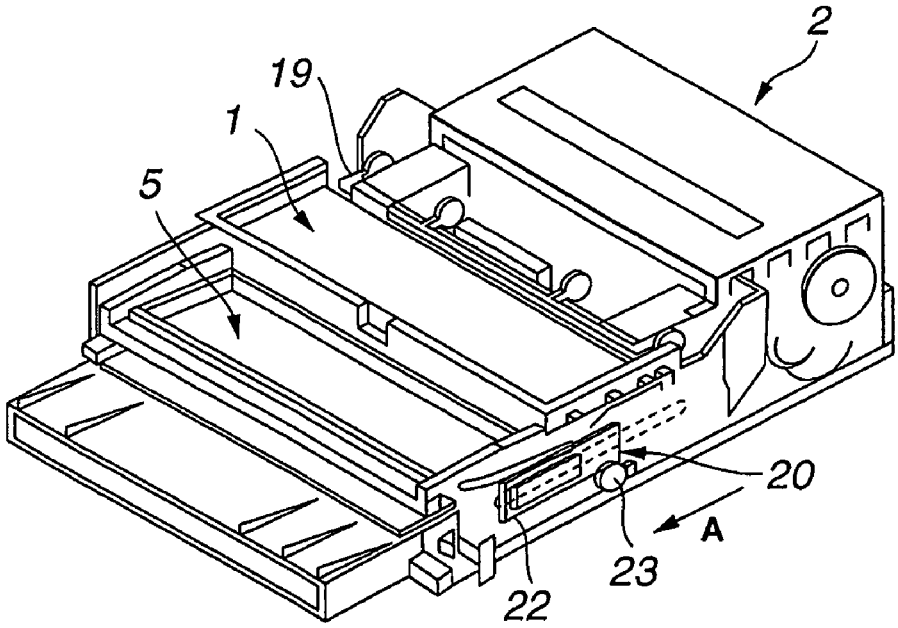
FIG. 13 is a perspective view showing an ink jet printer and specifically showing the state in which the head cap has been opened.

Referring to FIG. 12, the pinion 23 is rotated by a motor, not shown, in a preset direction, as the ink jet head 1 is secured to a preset location of the main body unit of the printer 2 by the head mounting/dismounting unit 19. By so doing, the rack 22 is moved along the direction of arrow A, as shown in FIG. 13, and thereby the head cap 5 shown in FIG. 1 is moved along the direction of arrow A and opened so as to be positioned in the receded position.

The head cap opening/closing unit 20 is not limited to the above-described combination of the rack 22 and the pinion 23 meshing therewith. For example, a pair of rubber rolls may be thrust against the lateral sides of the head cap 5 and a motor may be connected to rotational shafts of the rubber rolls, with the head cap 5 being moved along the direction of arrow A by friction of the rubber rolls produced on rotating the motor.

The specified mechanism and operation of causing relative movement between the head cap 5 and the print head 4 (see FIG. 2), with the ink jet head 1 being secured to the preset location of the main body unit of the printer 2 shown in FIG. 1 to expose the ink emitting surfaces 6 (see FIG. 2) to outside, are now explained with reference to FIGS. 14 to 18.

Figure 14:
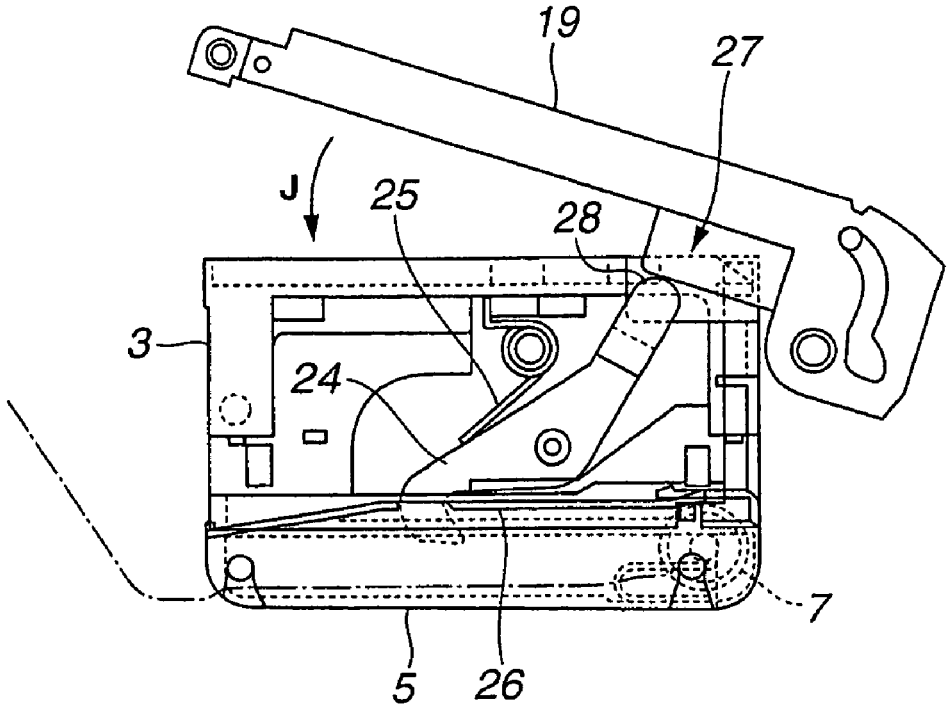
FIG. 14 illustrates a specified structure and operation in which the ink jet head has been inserted and housed in a preset location of a main body unit of the printer along the direction of an arrow H in FIG. 1.

FIG. 14 shows the state in which the ink jet head 1 in FIG. 1 is housed on insertion along the direction H to a predetermined location of the main body unit of the printer 2. In this state, the lower ends of a pair of cap lock hooks 24, provided to both lateral sides of the inner space of the ink jet head 1, are engaged with retention pieces 26 on both lateral sides of the head cap 5 under the elastic force of a helical spring 25. By so doing, the head cap 5 is loaded to the ink cartridge 3 to form a sole unit.

Figure 15:
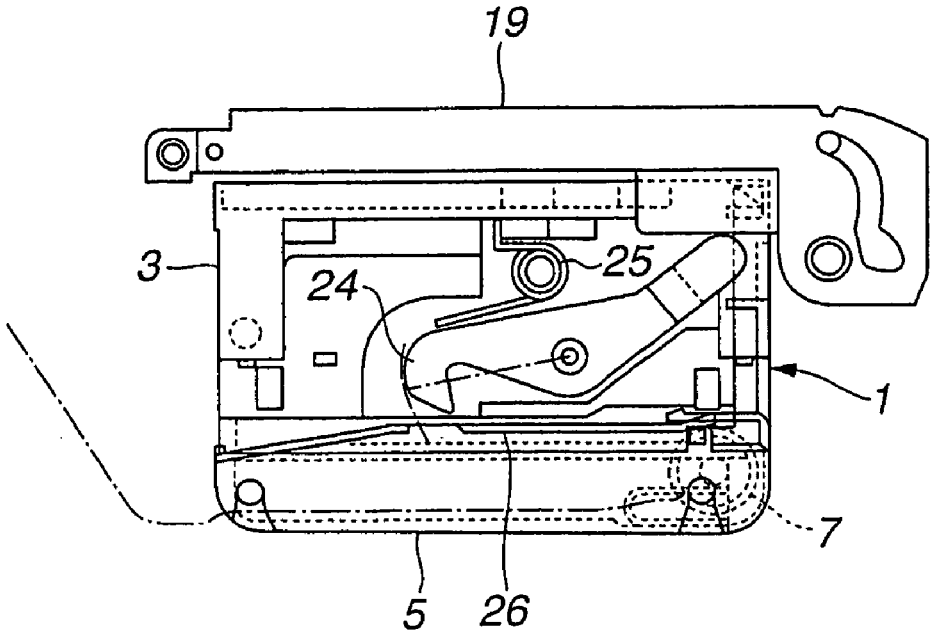
FIG. 15 illustrates a specified structure and operation in which the ink jet head has been secured in a preset location of the main body unit of the printer by a head mounting/dismounting mechanism, with the head cap being movable.

Under this condition, the head mounting/dismounting unit 19 is secured on pressing down along the direction of arrow J in FIG. 14. A cap unlock piece 27, provided to the lower side of the head mounting/dismounting unit 19, thrusts the upper ends 28 of the cap lock hooks 24 downward into rotation to uplift the lower ends of the cap lock hooks 24 for disengaging the cap lock hooks 24 from the retention pieces 26 on both lateral sides of the head cap 5, as shown in FIG. 15. This secures the ink jet head 1 in a preset location of the main body unit of the printer 2 by the head mounting/dismounting unit 19, with the head cap 5 being movable, as shown in FIG. 12.

Figure 16:
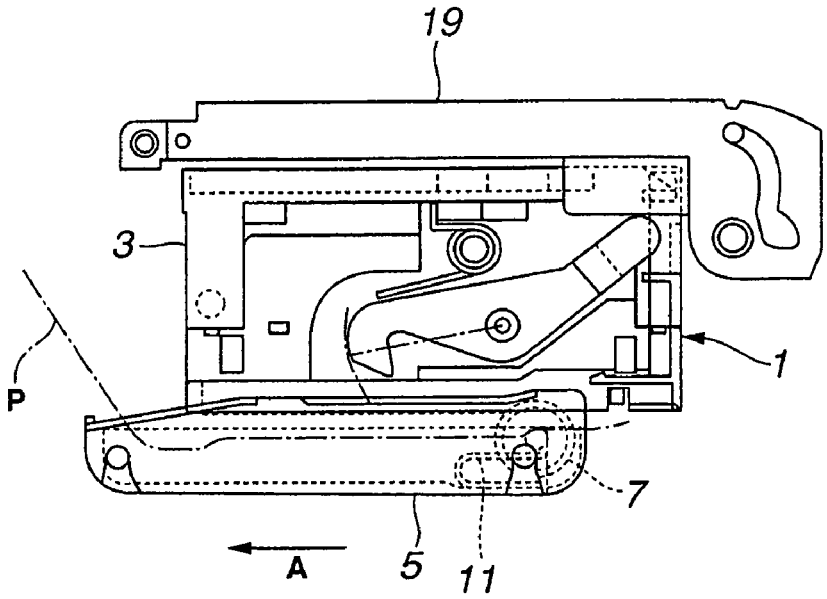
FIG. 16 illustrates a specified structure and operation in which the head cap loaded on the bottom surface of an ink cartridge is moved along the direction of an arrow A and opened.

The head cap opening/closing unit 20, shown in FIG. 12, then is actuated, such that the pinion 23 is run in rotation by the motor, not shown, for causing movement of the rack 22 along the direction of the arrow A. The head cap 5, mounted to the bottom surface of the ink cartridge 3, is then opened as it is moved along the direction of arrow A along with the rack 22, as shown in FIG. 16. The cleaning of the ink emitting surfaces 6 of the print head 4, provided to the bottom surface of the ink cartridge 3, by the cleaning roll 7, biased by the floating spring 11, then is started, as shown in FIG. 2. In FIG. 16, P denotes the movement trajectory of the head cap 5.

Figure 17:
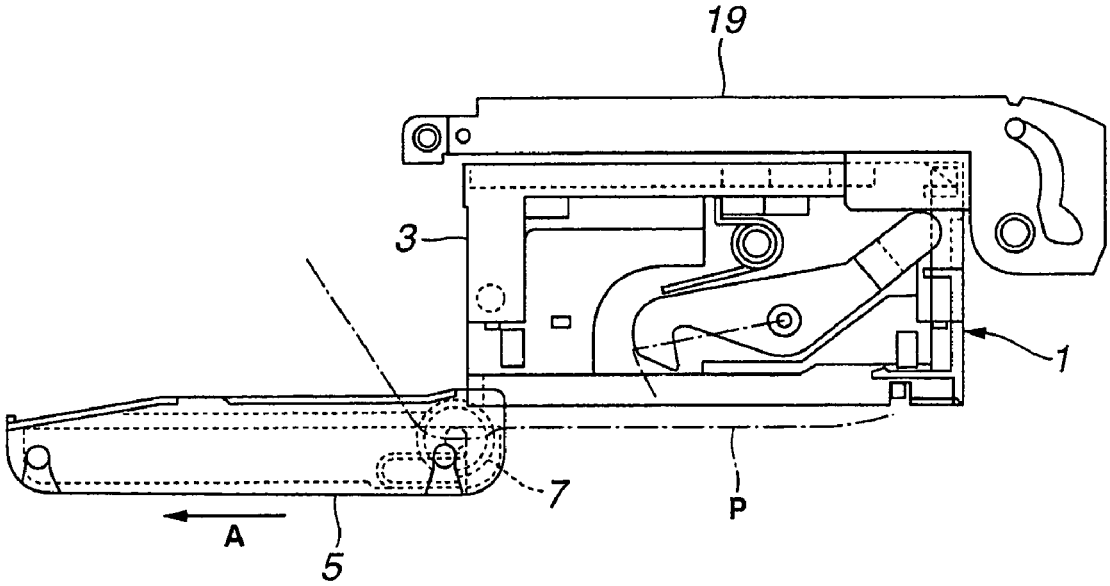
FIG. 17 illustrates a specified structure and operation in which the head cap is sequentially moved along the direction of the arrow A in accordance with a movement trajectory P.

The head cap 5 is then sequentially moved along the direction A, along the movement trajectory P, as shown in FIG. 17. At this time, the ink emitting surfaces 6 of the respective colors Y, M, C and K, shown in FIG. 2, are sequentially cleaned by the cleaning roll 7 mounted to the head cap 5. After the cleaning, the inks are preliminarily emitted.

Figure 18:
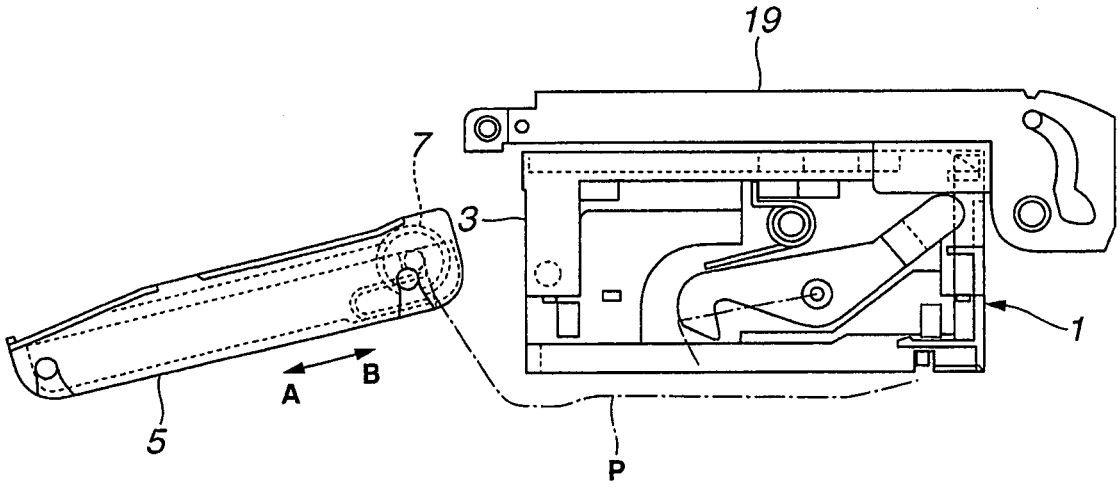
FIG. 18 illustrates a specified structure and operation in which the head cap is moved to the full stroke along the direction of the arrow A in accordance with the movement trajectory P and has reached a receded position.

When the cleaning and the preliminary ink emission of the ink emitting surfaces 6 of the respective colors have come to a close, the head cap 5 is moved to its full stroke, along the direction of arrow A, along the movement trajectory P, and is slightly uplifted, as shown in FIG. 18. so as to be positioned in the receded position, as shown in FIG. 13. Under this condition, the text or the image is printed on the recording sheet. Since the head cap 5 is moved slightly upwards, as shown in FIG. 18, the housing space of the head cap 5 may be reduced. In FIG. 18, the recording sheet travels below the print head 4 provided on the bottom surface of the ink cartridge 3. Alternatively, the lower surface of the head cap 5 may be designed to guide the traveling recording sheet. In this case, the lower surface of the head cap 5 may be provided with a rib for guiding the recording sheet. The lower surface of the head cap may be subjected to water-repellent processing to prevent affixture of the printing ink.

If, under this condition, the printing of the text and the image of a preset number of pages has come to a close, the head cap 5 is moved from the receded position shown in FIG. 18, along the direction of arrow B, by the sequence of operations reversed from that described above, up to the initial state in which the head cap 5 has been restored to the bottom surface side of the ink cartridge 3, as shown in FIG. 15.

The head mounting/dismounting unit 19 then is opened in the reverse direction to the direction shown by arrow J in FIG. 14, whereby the cap lock hooks 24 are engaged with the retention pieces 26 on both lateral sides of the head cap 5, under the force of the helical springs 25, so that the head cap 5 is mounted as one to the ink cartridge 3. Under this condition, the ink jet head 1 may be taken outward from the main body unit of the printer 2, as shown in FIG. 1.

If, with the head cap 5 in the receded position, shown in FIG. 18, the power supply of the printer is turned off, by some reason, the head cap 5 is left in the aforementioned receded position. If, in this state, the head mounting/dismounting unit 19 is opened in the reverse direction to that shown by arrow J, as shown in FIG. 14, only the ink cartridge 3 is dismounted, while the head cap 5 is left in the aforementioned receded position. In order to prevent this from occurring, an interlock mechanism may be provided, by means of which the head cap 5 in the receded position may be automatically restored to the initial state position shown in FIG. 14 in case the power supply of the printer is turned off, by some reason, or the head mounting/dismounting unit 19 is prohibited from being opened in the reverse direction to the direction shown by arrow J in case the head cap 5 has not been returned to the initial position shown in FIG. 14.

The ink jet printer, explained above with reference to FIGS. 1 and 12 to 18, the present invention is not limited to this and may be applied to the type in which the ink jet head 1 mounted via a tray to the main body unit of the printer 2. The schematics of the other type of the ink jet printer are now explained with reference to FIGS. 19A and 19B.

Figure 19A:
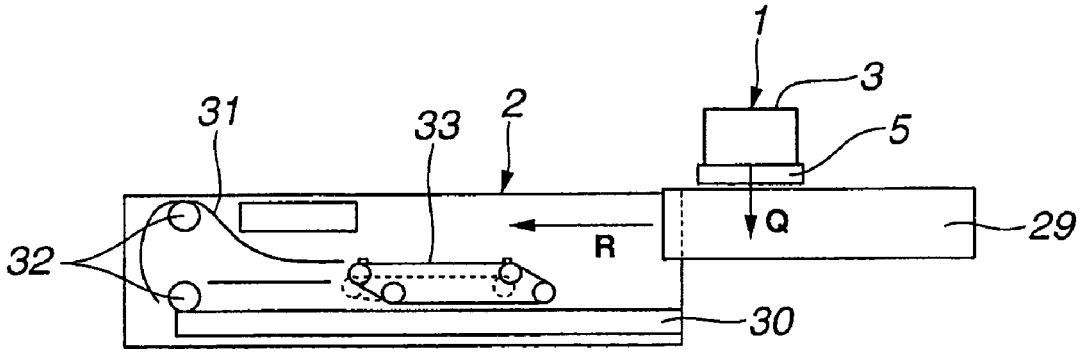
FIGS. 19A and 19B are schematic views showing an ink jet printer of another form in which the ink jet head is loaded on the main body unit of the printer via a tray.
Figure 19B:
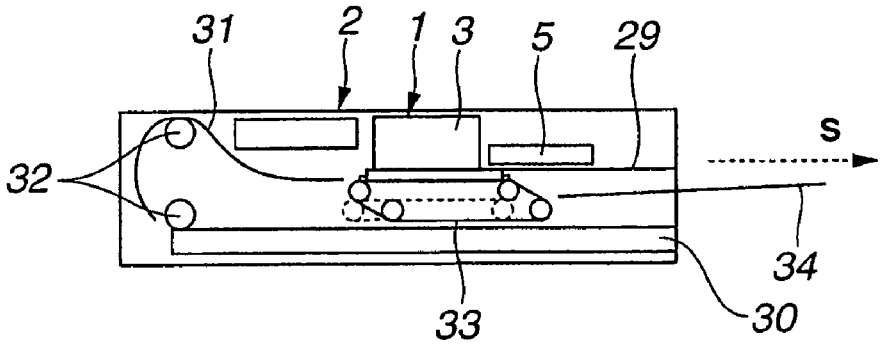

First, the ink jet head 1, comprising the ink cartridge 3, unified to the head cap 5, is mounted to a preset location on the inner side of the tray 29, provided for performing the movement in the fore-and-aft direction with respect to the main body unit of the printer 2, as indicated by arrow Q in FIG. 19A. The tray 29 is then moved along the direction R and set within the main body unit of the printer 2. In the course of the movement of the tray 29 along the direction R, the head cap 5 is halted by engaging with suitable retention means, provided within the main body unit of the printer 2, as shown in FIG. 19B. It is noted that the tray 29 is used for setting the ink jet head 1 within the main body unit of the printer 2 or exchanging the ink jet head.

The tray 29 then is moved straightforward along the direction R, whereby the ink cartridge 3 is moved along the direction R relative to the head cap 5, so that the head cap 5 is opened. Simultaneously, as the head cap 5 is moved relative to the ink cartridge 3, in the reverse direction to the direction of arrow R, the ink emitting surfaces 6 of the print head 4 are cleaned, and the ink is emitted preliminarily, by the operation similar to that shown in FIG. 11. The text or the image is then printed on the recording sheet. Meanwhile, in FIGS. 19A and 19B, the reference numerals 30 to 34 denote a tray for recording sheets, a recording sheet, a feed roll, a feed belt and a tray for discharged printed recording sheets, respectively, and the reference symbol S denotes the direction of discharging the recording sheets.

In the foregoing explanation, the image forming apparatus is an ink jet printer of the line head type. The present invention is, however, not limited to this and may also be applied to a serial type ink jet printer. Moreover, the present invention may be applied not only to the ink jet printer but may also be applied to an image forming apparatus, such as a facsimile device or a copying device operating under an ink jet recording system.

With the above-described modification of the present invention, the quantity of the ink preliminarily emitted via one or more of the ink emitting openings may be controlled, depending on the input image signals, by emission controlling means adapted for controlling the operation of emitting the ink via the ink emitting openings formed in the ink emitting surfaces of the print head.

Thus, the cleaning of the ink emitting openings and the vicinity thereof may be achieved, as the quantity of the emitted ink is diminished, without damaging the ink emitting surfaces.

Moreover, one or more of the ink emitting openings for preliminary ink emission may be selected, responsive to the input image signals, by the emission controlling means controlling the operation of emitting the ink via the ink emitting openings formed in the ink emitting surfaces of the print head. Consequently, the quantity of wasteful ink emission may be diminished to achieve the cleaning of the ink emitting openings and the vicinity thereof without damaging the ink emitting surfaces.

It should be noted that, by image signals, including a signal indicating the colors of the pixels associated with the ink emitting openings formed in the ink emitting surfaces of the print head, a signal indicating the quantity of ink emission or a signal for selecting the ink emitting openings, the quantity of the preliminary ink emission may be controlled, or the preliminary emission openings may be selected, in order to execute the operation of the preliminary ink emission.

Moreover, the operation of the preliminary emission may be controlled by the image signal controlling the preliminary emission in dependency upon the quantity of the ink ejected last time via the ink emitting openings. Consequently, the quantity of wasteful ink emission may be diminished to achieve the cleaning of the ink emitting openings and the vicinity thereof without damaging the ink emitting surfaces.

Additionally, the quantity of the preliminary ink emission may be set in dependency upon the time elapsed as from the time the ink was emitted last time. By so doing, the preliminary ink emission may be performed efficiently to blow off the solidified ink for the ink emitting opening which has not been used for a longer period of time for ink emission. Thus, the quantity of wasteful ink emission may be diminished to achieve the cleaning of the ink emitting openings and the vicinity thereof without damaging the ink emitting surfaces.

The quantity of the preliminary ink emission may also be controlled in dependency upon the number of electrical pulses flowing thought the electro-thermal transducing means provided in the ink tank charged with the ink. By so doing, the quantity or time of the preliminary ink emission may be varied, in dependency upon whether the ink has good or poor drying properties, thereby enabling efficient preliminary ink emission for blowing off the solidified ink. Thus, the cleaning of the ink emitting openings and the vicinity thereof may be achieved, as the quantity of the emitted ink is diminished, without damaging the ink emitting surfaces.

Moreover, in the print head for emitting the inks of the respective colors, including yellow, magenta, cyan and black, through the ink emitting openings in the ink emitting surfaces, the quantity of the preliminary ink emission may be varied in dependency upon whether the ink exhibits good or poor drying properties. In this manner, the quantity or time of the preliminary ink emission may be varied, in dependency upon whether the ink has good or poor drying properties, thereby enabling efficient preliminary ink emission for blowing off the solidified ink. Thus, the cleaning of the ink emitting openings and the vicinity thereof may be achieved, as the quantity of the emitted ink is diminished, without damaging the ink emitting surfaces.

The quantity of preliminary emission of the black ink may be larger than that of the remaining color inks. By so doing, the quantity or the time of the preliminary ink emission may be controlled to achieve more efficient preliminary emission in consideration of the difference in the drying performance caused by difference in the content or the molecular weight of the dyestuffs. Thus, the cleaning of the ink emitting openings and the vicinity thereof may be achieved, as the quantity of the emitted ink is diminished, without damaging the ink emitting surfaces.

Furthermore, a cap member may be provided which internally holds the columnar-shaped cleaning member of an elastic material and which protects the ink emitting surfaces of the print head, whilst movement means may also be provided which causes relative movement between the cleaning member and the print head. By so doing, the cleaning member may be provided within the cap member, whilst the ink emitting surfaces of the print head may be protected by the cap member. In addition, the cleaning member and the ink emitting surfaces may be moved relative to each other by the opening movement of the cap member. The ink left in the ink emitting openings may be removed on suction by the cleaning member being elastically deformed during this movement. The result is that the quantity of wasteful ink emission may be diminished to achieve the cleaning of the ink emitting openings and the vicinity thereof without damaging the ink emitting surfaces.

The cleaning of the ink emitting openings by the cleaning member may be achieved before or after the preliminary ink emission. If the cleaning of the ink emitting openings by the cleaning member is carried out directly after the operation of the preliminary ink emission, the ink left in the vicinity of the ink emitting openings by the preliminary ink emission may be removed by the cleaning member, thus assuring efficient cleaning of the ink emitting surfaces. If the cleaning of the ink emitting openings by the cleaning member is carried out just before the operation of the preliminary ink emission, the solidified ink left in the ink emitting openings may be removed to assure subsequent smooth preliminary ink emission. Thus, the quantity of wasteful ink emission may be diminished to achieve the cleaning of the ink emitting openings and the vicinity thereof without damaging the ink emitting surfaces.

The structure and the control operation of the control device unit, controlling the modification of the image forming apparatus, are now explained with reference to FIGS. 20 and 21. The parts or components in FIG. 20 which are the same as those of the above-described embodiment are depicted by the same reference numerals and are not explained specifically. In addition, the structure and the operation other than the structure shown in FIG. 20 and the control operation other than the control operation shown in FIG. 21 are the same as those of the above-described embodiment and the corresponding explanation is omitted for simplicity.

Figure 20:
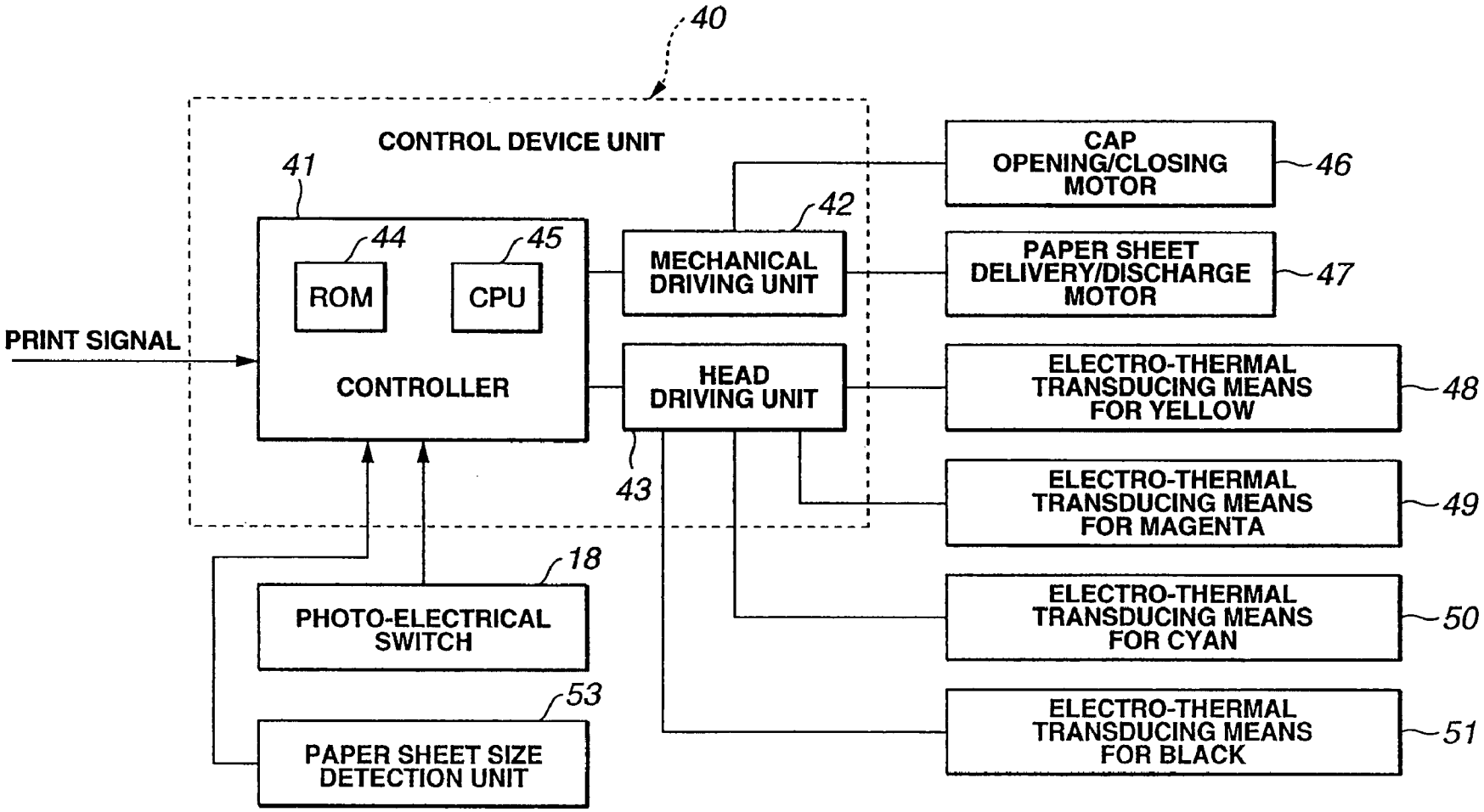
FIG. 20 is a block diagram for illustrating the structure and the operation of a controlling device unit for controlling another example of the image forming apparatus according to the present invention.
Figure 21:
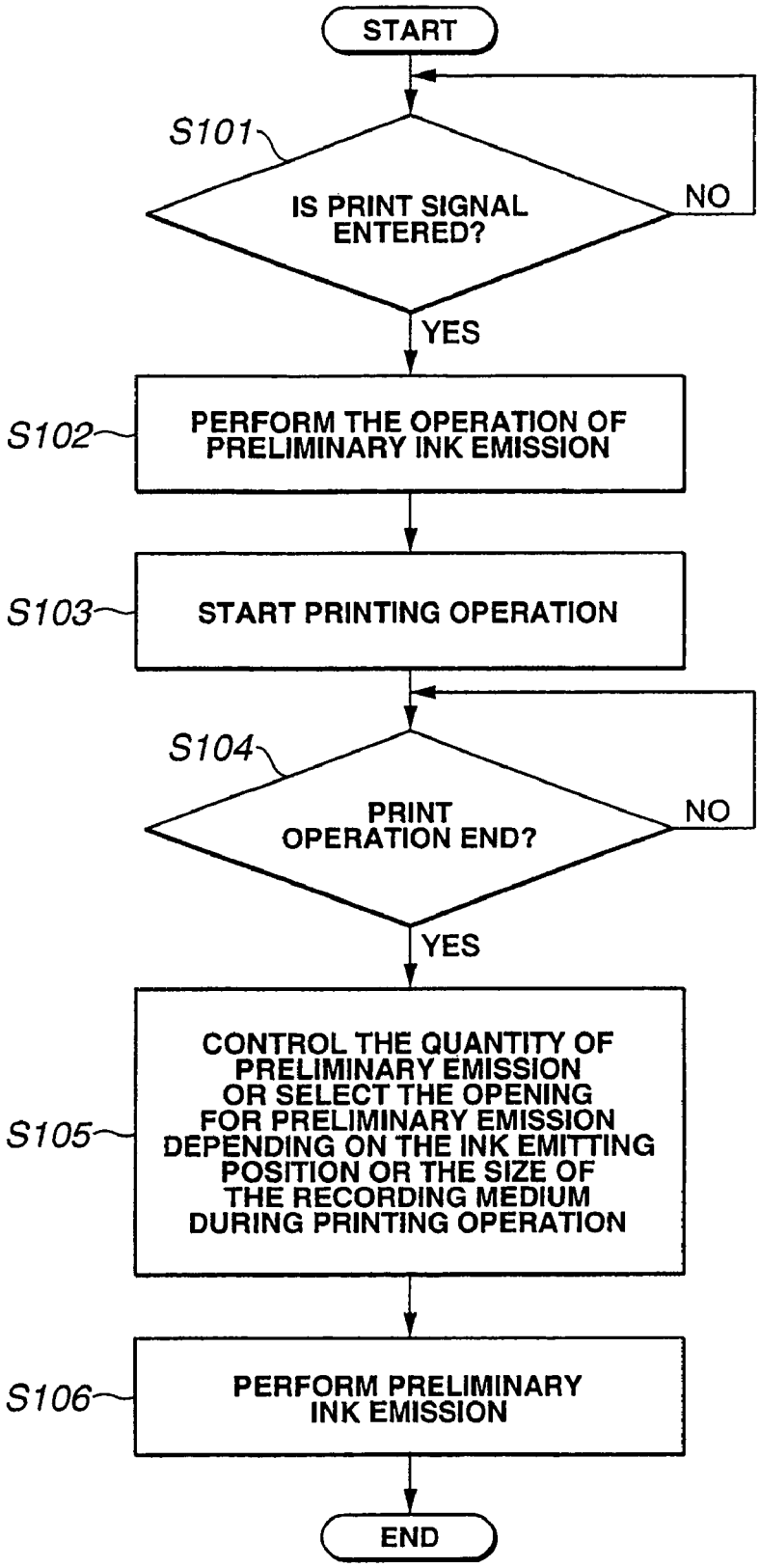
FIG. 21 is a flowchart showing a control method for the example of the image forming apparatus of the present invention and mainly showing the control of the operation of preliminarily emitting the ink.

The controller 41 shown in FIG. 20 is supplied with a signal indicating the size of the recording medium, as output from a paper sheet size detection unit 53, as later explained, and performs the operation of the preliminary ink emission based on this signal.

This paper sheet size detection unit 53 operates as a recording medium detecting means for detecting the size of the recording medium, such as printing paper sheet or a seal paper sheet, and is mounted on, for example, the main body unit of the printer 2 or the paper sheet feeder cartridge 21 shown in FIG. 1, although the manner of mounting the paper sheet size detection unit is not shown. When the printing paper sheet of a predetermined size is set on the paper sheet feeder cartridge 21, the paper sheet size detection unit 53 detects the size to output the resulting detection signal to the controller 41.

FIG. 20 depicts a flowchart showing the controlling method for the image forming apparatus, constructed as described above, and mainly shows the control of the operation of preliminarily emitting the ink via the ink emitting openings in the print head 4. Meanwhile, this control is carried out under instructions from the CPU 45 based on a control program stored in the ROM 44 in the controller 41 shown in FIG. 20.

When the job of FIG. 20 is started and, in a step S101, a print signal indicating the start of the operation for image forming is supplied to the controller 41 shown in FIG. 20, the controller 41 in a step S102 sends an emission trigger signal for driving the electro-thermal transducing means 48 to 51 of the respective colors to the head driving unit 43, which head driving unit then sends electrical signals to the electro-thermal transducing means 48 to 51 of the respective colors to execute the operation of the preliminary ink emission. Meanwhile, the step S102 effects the preliminary ink emission prior to start of the printing operation and hence may be omitted.

It should be noted that the preliminary ink emission plays an important role in preventing the ink in the ink emitting openings from becoming thickened or solidified, as mentioned previously. That is, if the ink is accumulated in the ink emitting openings and thickened or solidified to a high viscosity, the ink cannot be emitted smoothly during printing. In case the ink is thickened or solidified excessively, the clogging occurs. Thus, the cleaning of the inside of the ink emitting openings by the preliminary ink emission plays the role of cleaning the ink emitting openings and the vicinity thereof by the cleaning roll 7 shown in FIG. 6 and prohibiting the clogging.

In the control device unit 40, shown in FIG. 20, the print signal indicating the start of the operation for image forming is supplied to the controller 41, and subsequently the ink is preliminarily emitted through the ink emitting openings. In this manner, the ink, used up to the latest emission and left in the vicinity of the ink emitting openings in the highly thickened or solidified state, may be blown off to outside from the ink emitting openings. This blow-off operation serves for cleaning the ink emitting openings to prevent the ink emitting openings from becoming clogged with the ink thickened or solidified to a high viscosity to permit the ink to be emitted subsequently smoothly from the ink emitting openings, and enables the subsequent printing operation, that is, the ink emitting operation, to be carried out efficiently.

After the operation of preliminary ink emission, shown in the step S102 in FIG. 21, the printing operation, that is the operation of emitting the ink via the ink emitting openings, is carried out in a step S103. Then, processing transfers to a step S104. Until the photo-electrical switch 18, shown in FIG. 20, detects the print operation end signal, the "NO" path of the step S104 is followed, with the respective ink emission openings continuing the ink emitting operation based on the print signal. When the photo-electrical switch 18 shown in FIG. 20 detects the print operation end signal, the "YES" branch of the step S104 is followed, such that a print end signal is sent from the photo-electrical switch 18 to the controller 41.

In a step S105, shown in FIG. 21, a means for detecting the ink emitting position or a means for deciding on the ink emitting opening used for the preliminary ink emission, both provided to the controller 41, detects the ink emitting position during the print operation (step S104) prior to the operation of the preliminary emission from an optional ink emitting opening. Based on the detected result, the quantity of the preliminary ink emission from the ink emitting openings is controlled, or one or more ink emitting openings is detected. Then, in a step S106, a signal indicating the quantity of the preliminary ink emission is sent to the selected ink emitting opening(s), which then execute the operation of the preliminary ink emission.

When the operation of the preliminary ink emission in this step S106 has come to a close, the job comes to a close.

As for the size of the printing paper sheets, as recording mediums, the size of A3, B4, A4 or B5, for example, is usually employed. Depending on the size of the printing paper sheets, the printing paper sheets are set in the paper sheet feeder cartridge 21 of the image forming apparatus shown in FIG. 1. This paper sheet feeder cartridge 21 is shaped to single side reference, such as right adjust or left adjust, or double side reference, and is mounted in such a position in which the paper sheets may automatically be fed to an area where the ink emitting opening operates for printing on the printing paper sheet as the ink emitting opening emits the ink. The size of the printing paper sheet or of the paper sheet feeder cartridge 21 is detected in this manner by the paper sheet size detection unit 53 shown in FIG. 20.

When the print signal is supplied to the controller 41, the operating extent of the ink emitting surfaces provided with the ink emitting openings is set, and the ink emitting openings supplied with the print signal and the ink emitting openings not supplied with the print signal are determined in association with the operating extent of the ink emitting surfaces. The space in register with the ink emitting openings, not supplied with the print signal, corresponds to the space on the printing paper sheet which is not to be printed. In case such space is included in the print signal, no ink is supplied from the ink emitting openings of the respective colors to the space, such that the ink emitting openings of the colors in question tend to be dried.

If, in such case, the quantity of the preliminary ink emission from the ink emitting openings of the respective colors, following the detection of the print operation end signal, is set to a larger value, the ink left solidified in the ink emitting openings may be removed efficiently. That is, wasteful preliminary ink emission may be eliminated by setting the quantity of the preliminary ink emission of the respective colors or the ink emitting openings in dependency upon the size of the printing paper sheets or the shape of the paper sheet feeder cartridge 21.

In the above explanation, it is presupposed that the ink emitting position corresponding to the size of the recording medium during the printing operation prior to the operation of the preliminary ink emission from the ink emitting opening may be detected by the controller 41 shown in FIG. 20. The present invention is not limited to this, and the ink emitting position in question may be detected by the head driving unit 43. In this case, the head driving unit 43 is provided with a means for detecting the position of the emitted ink or with a means for deciding on the ink emitting opening to be used for preliminary ink emission. These means detect the ink emitting position during the printing operation prior to the operation of the preliminary ink emission from optional ink emitting openings to control the quantity of the preliminary emission from the ink emitting openings in question, or select one or more of the ink emitting openings to send a signal indicating the quantity of the preliminary emission of the respective inks to the selected ink emitting openings to permit the ink emitting openings to emit the inks preliminarily. The print signal may be provided with an identifier for discriminating the position of ink emission corresponding to the size of the recording medium during the printing operation prior to the preliminary ink emission from the ink emitting opening in question.

In the above explanation, the step S105 shown in FIG. 21 refers to the print signal output just before the preliminary emission from the ink emitting opening. The present invention is not limited to this such that the quantity of the preliminary ink emission from the ink emitting opening to be carried out next time may also be controlled as described above. With the image forming apparatus and the control method therefor, in which the position of emission of the inks, corresponding to the size of the recording medium, which inks were emitted from the ink emitting openings by the past several printing operations or ink emitting operations, may be detected, and the total quantity of the inks of the respective colors may be detected, it is possible to decide on the total quantity of the preliminary ink emission from the ink emitting openings of the respective colors, as calculated based on the total quantity of the inks of the respective colors, and to send a signal, indicating the quantity of the preliminary emission from the ink emitting openings of the respective colors, thus determined, to an emission controlling means provided to the controller 41 or to the head driving unit 43 shown in FIG. 20.

The signal sent to the controller 41, and indicating the quantity of the preliminary emission from the ink emitting openings of the respective colors, is sent to the head driving unit 43. The signal indicating the quantity of the preliminary emission from the ink emitting openings of the respective colors is sent from the head driving unit 43 to the electro-thermal transducing means 48 to 51 of the respective colors and the preliminary emission is executed in a quantity of preliminary emission based on the total quantity of emission of the inks of the respective colors of the latest several emissions from the ink emitting openings.

The signal for preliminary emission, output from the CPU 45 as emission control means in the controller 41 shown in FIG. 20 in the step S105 shown in FIG. 21, may be set in dependency upon the time elapsed as from the last emission. In this case, the time signal detection means, provided to the controller 41, detects a signal indicating the time of transmission of the electrical pulses to the electro-thermal transducing means 48 to 51 of the respective colors, which emitted the inks last time, from the image signal supplied last time. The time signal detection means detects the time when the respective ink emitting openings emitted the inks for printing, which time is closest to the current time, and calculates the difference of the detected time from the current time, and sets the time of the preliminary emission or the quantity of the preliminary emission, so that, the larger the time difference for given ink emitting openings, the longer is the time of the preliminary emission or the larger is the quantity of the preliminary emission for these ink emitting openings.

Since the longer the time given ink emitting openings have not been used up to now, the higher is the probability that the thickened or solidified ink, produced by the thickening of the emitted ink to a high viscosity, is left in these ink emitting openings, such thickened or solidified ink may be blown off by efficient preliminary emission.

Moreover, in the step S105 shown in FIG. 21, the control of the quantity of the preliminary ink emission in the operation of preliminary emission may be determined by the number of times the electrical pulses are caused to flow in the electro-thermal transducing means in the ink tank charged with the ink. These electrical pulses are generated by an electrical pulse generating means provided in the controller 41, shown in FIG. 20, and transmitted to the head driving unit 43, and thence supplied to the electro-thermal transducing means 48 to 51, in order to perform the preliminary emission of inks of respective colors. The electrical pulse generating means are not used solely for preliminary emission and may be the same as the electrical pulse generating means used for emitting the ink during the printing operation. In this case, there is no necessity of providing two electrical pulse generating means, namely the electrical pulse generating means for printing and the electrical pulse generating means for emission, thus realizing the space efficiency of the integrated circuit.

In the step S105 shown in FIG. 21, the ink jet head 1 shown in FIG. 1 may emit the inks of respective colors, including yellow, magenta, cyan and black, from the ink emission openings of the ink emitting surfaces of the ink jet head 1, and the aforementioned emission control means may control the quantity of the preliminary emission depending on the colors of the inks emitted from the ink emitting openings. By so doing, the quantity or time duration of the preliminary ink emission may be varied, in dependency upon whether the ink has good or poor drying properties, thereby enabling efficient preliminary ink emission for blowing off the solidified ink.

In particular, the amounts of the preliminary ink emission at this time are preferably set so that the black ink may be preliminarily emitted in a larger quantity than the other inks. The reason is that the black ink has such properties that the quantity of the dye material added is larger, the molecular weight of the dyestuff is larger and the viscosity is higher than those of the other color inks, that is, the inks of yellow, magenta or cyan, and hence the quantity of the preliminary ink emission through the black ink emitting openings must be larger and the time for preliminary emission the black ink must be longer. Of course, the longer the preliminary ink emission time duration, the larger is the quantity of the preliminary ink emission. On the other hand, in the color inks of yellow, magenta or cyan, there is a difference in the drying performance, depending on the content as well as the molecular weight of the dyestuff, such that an efficient preliminary ink emission operation may be achieved as to the quantity or the time of the preliminary ink emission, by taking the drying performance into account.

The image forming apparatus of the present invention may be provided with a head cap 5, having housed therein the cleaning roll 7 formed of an elastic material to a columnar shape as shown in FIG. 2, and including the head cap 5 for protecting the ink emitting surfaces 6 of the print head 4. The image forming apparatus of the present invention may further be provided with the mechanical driving unit 42 (see FIG. 9) as movement means for causing relative movement between the cleaning roll 7 and the print head 4. By so doing, the cleaning roll 7 may be housed within the head cap 5, while the ink emitting surfaces of the print head 4 may be protected by the head cap 5 and the relative movement between the cleaning roll 7 and the ink emitting surfaces may be achieved by the opening movement of the head cap 5. The thickened ink in the ink emitting openings may be sucked and removed by elastic deformation of the cleaning roll 7 during this relative movement.

At this time, the cleaning of the ink emitting openings by the cleaning roll 7 is preset to occur before or after the preliminary ink emission. In particular, if the cleaning of the ink emitting openings by the cleaning roll 7 is pre-set to occur directly after the operation of the preliminary ink emission, the ink left in the vicinity of the ink emitting openings as a result of the preliminary emission may be removed by the cleaning roll 7, so that the ink emitting surfaces 6 may be cleaned efficiently.

If the cleaning of the ink emitting openings by the cleaning roll 7 is pre-set to occur just before the operation of the preliminary ink emission, the thickened or solidified ink left within the ink emitting openings may be removed to enable smooth preliminary ink emission subsequently.

If, in the step S105 shown in FIG. 21, the photo-electrical switch 18 shown in FIG. 20 detects the cleaning by the cleaning roll 7, and the photo-electrical switch 18 then sends out a signal, indicating such detection, to the controller 41, an emission controlling means, provided in the controller 41, is able to control the quantity or time of the preliminary ink emission, or to select the ink emitting openings via which to emit the inks, as the time of cleaning by the cleaning roll 7 and the time the ink emitting openings emitted the ink last time or during the latest past time, in the sent signal, are taken into account.

For example, if, in the step S105, the time of cleaning by the cleaning roll 7 in the latest past time excluding the last time is close to the current time, the quantity of the preliminary ink emission may be decreased, or the time of the preliminary ink emission may be shortened, thereby improving the efficiency in preliminary ink emission.

In the above explanation of the cleaning operation by the cleaning roll 7, the operation of the preliminary ink emission is performed after the cleaning of the ink emitting surfaces 6 of the print head 4. However, if there is no fear of color mixing by the cleaning roll 7 contacted with the ink emitting surfaces 6, the preliminary ink emission may be carried out before cleaning of the ink emitting surfaces 6 by the cleaning roll 7. In this case, it is unnecessary to control the timing of the preliminary emission from the ink emitting openings of the inks of the respective colors of Y, M, C and K by the photo-electrical switch 18 shown in FIG. 20.

According to the present invention, described above, the quantity of preliminary ink emission from the ink emitting openings may be controlled by emission controlling means, controlling the operation of ink emission from the ink emitting openings formed in the ink emitting surfaces of the print head, in dependency upon the ink emitting positions corresponding to the size of the recording medium during the printing operation before the operation of the preliminary emission from the ink emitting openings. Thus, the quantity of wasteful ink emission may be diminished to achieve the cleaning of the ink emitting openings and the vicinity thereof without damaging the ink emitting surfaces.

Moreover, the quantity of preliminary ink emission from the ink emitting openings may be controlled by emission controlling means, controlling the operation of ink emission from the ink emitting openings formed in the ink emitting surfaces of the print head, in dependency upon the ink emitting positions corresponding to the size of the recording medium during the printing operation before the operation of the preliminary emission from the ink emitting openings, and upon the input image signals. Thus, the effect of cleaning of the ink emitting openings and the vicinity thereof may be realized, as the wasteful ink emission is avoided, without damaging the ink emitting surfaces.

Additionally, one or more ink emitting openings may be selected by emission controlling means, controlling the operation of ink emission from the ink emitting openings formed in the ink emitting surfaces of the print head, in dependency upon the ink emitting positions corresponding to the size of the recording medium during the printing operation before the operation of the preliminary emission from the ink emitting openings. Thus, the quantity of wasteful ink emission may be diminished to achieve the cleaning of the ink emitting openings and the vicinity thereof without damaging the ink emitting surfaces.

Additionally, one or more ink emitting openings may be selected by emission controlling means, controlling the operation of ink emission from the ink emitting openings formed in the ink emitting surfaces of the print head, in dependency upon the ink emitting positions corresponding to the size of the recording medium during the printing operation before the operation of the preliminary emission from the ink emitting openings, and upon the input image signals. Thus, the cleaning of the ink emitting openings and the vicinity thereof may be achieved, as the quantity of wasteful ink emission is diminished, without damaging the ink emitting surfaces.

It should be noted that the operation of preliminary emission may be controlled by image signals controlling the preliminary emission in dependency upon the quantity of the ink emitted last time from the ink emitting openings. Thus, the quantity of wasteful ink emission may be diminished to achieve the cleaning of the ink emitting openings and the vicinity thereof without damaging the ink emitting surfaces.

The quantity of preliminary ink emission may be set in dependency upon the time elapsed as from the time the ink was emitted last time. By so doing, the longer the time given ink emitting openings were not used during the latest time, the more efficient is the preliminary emission in blowing off the thickened or solidified ink. Consequently, the cleaning of the ink emitting openings and the vicinity thereof may be achieved, as the quantity of wasteful ink emission is diminished, without damaging the ink emitting surfaces.

The quantity of preliminary ink emission may also be controlled by the number of times the electrical pulses are caused to flow in the electro-thermal transducing means in the ink tank charged with the ink. In this manner, the quantity or time duration of the preliminary ink emission may be varied, in dependency upon whether the ink has good or poor drying properties, thereby enabling efficient preliminary ink emission for blowing off the solidified ink. Thus, the cleaning of the ink emitting openings and the vicinity thereof may be achieved, as the quantity of wasteful ink emission is diminished, without damaging the ink emitting surfaces.

In a print head emitting the inks of respective colors, including yellow, magenta, cyan and black from the ink emitting openings in the ink emitting surfaces, the quantity of preliminary ink emission may be controlled in dependency upon the colors of the inks emitted from the ink emitting openings. In this manner, the quantity or time duration of the preliminary ink emission may be varied, in dependency upon whether the ink has good or poor drying properties, thereby enabling efficient preliminary ink emission for blowing off the solidified ink. Thus, the cleaning of the ink emitting openings and the vicinity thereof may be achieved, as the quantity of wasteful ink emission is diminished, without damaging the ink emitting surfaces.

The quantity of preliminary emission of the black ink may be larger than that of the remaining color inks. By so doing, the quantity or the time of the preliminary ink emission may be controlled to achieve more efficient preliminary emission in consideration of the difference in the drying performance caused by difference in the content or the molecular weight of the dyestuffs. Thus, the cleaning of the ink emitting openings and the vicinity thereof may be achieved, as the quantity of wasteful ink emission is diminished, without damaging the ink emitting surfaces.

Furthermore, a cap member may be provided which internally holds a columnar-shaped cleaning member of an elastic material, and which protects the ink emitting surfaces of the print head, whilst movement means may also be provided which causes relative movement between the cleaning member and the print head. By so doing, the cleaning member may be provided within the cap member, whilst the ink emitting surfaces of the print head may be protected by the cap member. In addition, the cleaning member and the ink emitting surfaces may be moved relative to each other by the opening movement of the cap member. The ink left in the ink emitting openings may be removed on suction by the cleaning member being elastically deformed during this movement. The result is that the quantity of wasteful ink emission may be diminished to achieve the cleaning of the ink emitting openings and the vicinity thereof without damaging the ink emitting surfaces.

The cleaning of the ink emitting openings by the cleaning member may be achieved before or after the preliminary ink emission. If the cleaning of the ink emitting openings by the cleaning member is carried out directly after the operation of the preliminary ink emission, the ink left in the vicinity of the ink emitting openings by the preliminary ink emission may be removed by the cleaning member, thus assuring efficient cleaning of the ink emitting surfaces. If the cleaning of the ink emitting openings by the cleaning member is carried out just before the operation of the preliminary ink emission, the solidified ink left in the ink emitting openings may be removed to assure subsequent smooth preliminary ink emission. Thus, the quantity of wasteful ink emission may be diminished to achieve the cleaning of the ink emitting openings and the vicinity thereof without damaging the ink emitting surfaces.

The present invention is not limited to the above-described embodiments and, as may be apparent to those skilled in the art, various changes or substitutions may be made without departing from the purport of the invention as defined in the claims.

INDUSTRIAL APPLICABILITY

The image forming apparatus and the control method therefor, according to the present invention, may be utilized in e.g. an ink jet printer which is in widespread use because of low running costs and ease with which a color print image may be produced and the size of the apparatus may be reduced.

The invention claimed is:

1. An image forming apparatus including a print head provided with an ink emitting surface having a plurality of ink emitting openings, in which an ink is emitted from said ink emitting openings to form an image on a recording medium, said apparatus comprising emission controlling means for controlling the operation of ink emission from said ink emitting openings in said ink emitting surface; wherein said emission controlling means controlling the quantity of preliminary emission of the ink via one or more of the ink emitting openings in dependency upon an ink emitting position corresponding to the size of the recording medium during the printing operation prior to the operation of the preliminary emission via said one or more of the ink emitting openings.

2. An image forming apparatus including a print head provided with an ink emitting surface having a plurality of ink emitting openings, in which an ink is emitted from said ink emitting openings to form an image on a recording medium, said apparatus comprising emission controlling means for controlling the operation of ink emission from said ink emitting openings in said ink emitting surface; wherein said emission controlling means controlling the quantity of preliminary emission of the ink via one or more of said ink emitting openings in dependency upon an ink emitting position corresponding to the size of the recording medium during the printing operation prior to the operation of the preliminary emission via said one or more of the ink emitting openings and upon a supplied image signal.

3. An image forming apparatus including a print head provided with an ink emitting surface having a plurality of ink emitting openings, in which an ink is emitted from said ink emitting openings to form an image on a recording medium, said apparatus comprising emission controlling means for controlling the operation of ink emission from said ink emitting openings in said ink emitting surface; wherein said emission controlling means selecting one or more of the ink emitting openings for preliminary ink emission in dependency upon an ink emitting position corresponding to the size of the recording medium during the printing operation prior to the operation of the preliminary emission via said one or more of the ink emitting openings.

4. An image forming apparatus including a print head provided with an ink emitting surface having a plurality of ink emitting openings, in which an ink is emitted from said ink emitting openings to form an image on a recording medium, said apparatus comprising emission controlling means for controlling the operation of ink emission from said ink emitting openings in said ink emitting surface; wherein said emission controlling means selecting one or more of the ink emitting openings for preliminary ink emission in dependency upon an ink emitting position corresponding to the size of the recording medium during the printing operation prior to the operation of the preliminary emission via said one or more of the ink emitting openings and upon a supplied image signal.

5. The image forming apparatus according to any one of claims 1 to 4, wherein a signal indicating the size of the recording medium is contained in the image signal supplied to said emission controlling means.

6. A method for controlling an image forming apparatus including a print head provided with an ink emitting surface having a plurality of ink emitting openings, and emission controlling means for controlling the operation of ink emission from said ink emitting openings in said ink emitting surface, in which an ink is emitted from said ink emitting openings to form an image on a recording medium, wherein said emission controlling means controls the quantity of preliminary ink emission from one or more of the ink emitting openings in dependency upon an ink emitting position corresponding to the size of the recording medium during the printing operation prior to the operation of the preliminary emission via said one or more of the ink emitting openings.

7. A method for controlling an image forming apparatus including a print head provided with an ink emitting surface having a plurality of ink emitting openings, and emission controlling means for controlling the operation of ink emission from said ink emitting openings in said ink emitting surface, in which an ink is emitted from said ink emitting openings to form an image on a recording medium, wherein said emission controlling means controls the quantity of preliminary ink emission from one or more of the ink emitting openings in dependency upon an ink emitting position corresponding to the size of the recording medium during the printing operation prior to the operation of the preliminary emission via said one or more of the ink emitting openings and upon a supplied image signal.

8. A method for controlling an image forming apparatus including a print head provided with an ink emitting surface having a plurality of ink emitting openings, and emission controlling means for controlling the operation of ink emission from said ink emitting openings in said ink emitting surface, in which an ink is emitted from said ink emitting openings to form an image on a recording medium, wherein said emission controlling means performs control for selecting one or more of the ink emitting openings in dependency upon an ink emitting position corresponding to the size of the recording medium during the printing operation prior to the operation of the preliminary emission via said one or more of the ink emitting openings.

9. A method for controlling an image forming apparatus including a print head provided with an ink emitting surface having a plurality of ink emitting openings, and emission controlling means for controlling the operation of ink emission from said ink emitting openings in said ink emitting surface, in which an ink is emitted from said ink emitting openings to form an image on a recording medium, wherein said emission controlling means performs control for selecting one or more of the ink emitting openings in dependency upon an ink emitting position corresponding to the size of the recording medium during the printing operation prior to the operation of the preliminary emission via said one or more of the ink emitting openings and upon a supplied image signal.

10. The method for controlling an image forming apparatus according to any one of claims 6 to 9, wherein a signal indicating the size of the recording medium is contained in the image signal supplied to said emission controlling means.

* * * * *